US011871888B2

(12) United States Patent
Burbank et al.

(10) Patent No.: US 11,871,888 B2
(45) Date of Patent: Jan. 16, 2024

(54) CLEANING ROLLERS FOR CLEANING ROBOTS

(71) Applicant: iRobot Corporation, Bedford, MA (US)

(72) Inventors: Eric Burbank, Bedford, MA (US); Timothy R. Ohm, Grover Beach, CA (US); Erik Amaral, Lexington, MA (US)

(73) Assignee: iRobot Corporation, Bedford, MA (US)

( * ) Notice: Subject to any disclaimer, the term of this patent is extended or adjusted under 35 U.S.C. 154(b) by 286 days.

(21) Appl. No.: 17/466,559

(22) Filed: Sep. 3, 2021

(65) Prior Publication Data

US 2022/0047131 A1 Feb. 17, 2022

Related U.S. Application Data

(63) Continuation of application No. 16/288,699, filed on Feb. 28, 2019, now Pat. No. 11,109,727.

(51) Int. Cl.
*A47L 9/04* (2006.01)
*A47L 9/28* (2006.01)

(52) U.S. Cl.
CPC ..... *A47L 9/0477* (2013.01); *A47L 9/0411* (2013.01); *A47L 9/2852* (2013.01); *A47L 2201/04* (2013.01)

(58) Field of Classification Search
CPC ..... A47L 2201/00; A47L 2201/04; A47L 9/0411; A47L 9/0477; A47L 9/2852
See application file for complete search history.

(56) References Cited

U.S. PATENT DOCUMENTS 1,829,548 A 10/1931 Smellie et al.
1,907,642 A * 5/1933 Demaree ..... A47L 9/0477 15/141.2

(Continued)

FOREIGN PATENT DOCUMENTS

CA 2465710 10/2004
CN 1572223 2/2005

(Continued)

OTHER PUBLICATIONS

English Machine translation of DE 4112382, published on Oct. 22, 1992, 9 pages.

(Continued)

*Primary Examiner* — Marc Carlson
(74) *Attorney, Agent, or Firm* — Fish & Richardson P.C.

(57) ABSTRACT

A cleaning roller mountable to a cleaning robot is featured. The cleaning roller includes an elongate member extending along a longitudinal axis of the cleaning roller, and a vane extending outward from the elongate member. The vane includes a first vane portion attached to the elongate member, and a second vane portion attached to the first vane portion. The first vane portion extends from the elongate member at a location intersecting a radial axis of the cleaning roller. The first vane portion extends along a first axis angled relative to the radial axis and away from the radial axis in a tangential direction. The second vane portion extends along a second axis angled relative to the first axis. A first angle between the first axis and the radial axis is greater than a second angle between the second axis and the radial axis.

34 Claims, 21 Drawing Sheets

(56) References Cited

U.S. PATENT DOCUMENTS 1,919,067 A 7/1933 Lang et al.
2,064,856 A 12/1936 Riebel
D125,786 S 3/1941 Schaad
2,298,682 A 10/1942 Dahlstom et al.
2,578,549 A 12/1951 Hooban
2,770,825 A 11/1956 Kuroki et al.
2,881,461 A 4/1959 Parker et al.
D222,702 S 12/1971 Schaefer et al.
3,828,387 A 8/1974 Liebscher
4,042,997 A 8/1977 McDowell
4,307,479 A 12/1981 Mertes et al.
4,357,727 A 11/1982 McDowell
4,401,909 A 8/1983 Gorsek
4,552,505 A 11/1985 Gorman
4,679,152 A 7/1987 Perdue
4,777,691 A 10/1988 Richmond et al.
4,778,113 A 10/1988 Jewett et al.
4,832,098 A 5/1989 Palinkas et al.
4,908,898 A 3/1990 Kudo
4,912,805 A 4/1990 Krasznai
4,918,441 A 4/1990 Bohman
4,962,453 A 10/1990 Pong et al.
5,086,535 A 2/1992 Grossmeyer et al.
5,109,566 A 5/1992 Kobayashi et al.
5,148,569 A * 9/1992 Jailor ..... A47L 9/0477 15/230.14
5,204,814 A 4/1993 Noonan et al.
5,216,777 A 6/1993 Moro et al.
5,233,682 A 8/1993 Abe et al.
5,251,355 A 10/1993 Drumm
5,251,358 A 10/1993 Moro et al.
5,284,522 A 2/1994 Kobayashi et al.
5,321,614 A 6/1994 Ashworth
5,341,540 A 8/1994 Soupert et al.
5,365,634 A * 11/1994 Hughes ..... B08B 15/00 15/387
5,410,479 A 4/1995 Coker
5,452,490 A 9/1995 Brundula et al.
5,495,634 A * 3/1996 Brundula ..... A47L 9/0477 15/179
5,507,067 A 4/1996 Hoeskstra et al.
5,515,572 A 5/1996 Hoeskstra et al.
5,536,953 A 7/1996 Kurz
5,537,711 A 7/1996 Tseng
5,539,953 A 7/1996 Kawakami et al.
5,542,146 A 8/1996 Hoekstra et al.
5,548,511 A 8/1996 Bancroft
5,613,261 A 3/1997 Kawakami et al.
5,635,634 A 6/1997 Reusckenback et al.
5,646,494 A 7/1997 Han
5,682,313 A 10/1997 Edlund et al.
5,710,506 A 1/1998 Broell et al.
5,787,545 A 8/1998 Colens
5,813,086 A 9/1998 Ueno et al.
5,815,884 A 10/1998 Imamura et al.
5,867,800 A 2/1999 Leif
5,910,700 A 6/1999 Crotzer
5,935,179 A 8/1999 Kleiner et al.
5,942,869 A 8/1999 Katou et al.
5,959,423 A 9/1999 Nakanishi et al.
5,991,951 A 11/1999 Kubo
6,055,702 A 5/2000 Imamura et al.
6,076,025 A 6/2000 Ueno et al.
6,076,227 A 6/2000 Schallig et al.
6,091,219 A 7/2000 Maruo et al.
6,108,853 A 8/2000 Dittus
D431,698 S 10/2000 Hoshide et al.
6,212,732 B1 4/2001 Tajima et al.
6,220,865 B1 4/2001 Macri et al.
6,278,918 B1 8/2001 Dickson et al.
6,285,930 B1 9/2001 Dickson et al.
6,321,337 B1 11/2001 Reshef et al.
6,323,570 B1 11/2001 Nishimura et al.
6,370,453 B2 4/2002 Sommer
6,385,515 B1 5/2002 Dickson et al.
6,389,329 B1 5/2002 Colens
6,400,048 B1 6/2002 Nishimura et al.
6,437,465 B1 8/2002 Nishimura et al.
6,459,955 B1 10/2002 Bartsch et al.
6,463,368 B1 10/2002 Feiten et al.
6,470,237 B2 10/2002 Fujita et al.
6,490,539 B1 12/2002 Dickson et al.
6,505,341 B1 1/2003 Harris et al.
D471,332 S 3/2003 Haegermarck et al.
6,530,106 B1 3/2003 Brundula et al.
6,532,404 B2 3/2003 Colens
6,539,575 B1 4/2003 Cohen
6,553,612 B1 4/2003 Dyson et al.
6,556,892 B2 4/2003 Kuroki et al.
6,564,417 B2 4/2003 Porat et al.
6,574,536 B1 6/2003 Kawagoe et al.
6,574,823 B1 6/2003 Stegens
6,584,376 B1 6/2003 Van Kommer
6,594,844 B2 7/2003 Jones
D478,698 S 8/2003 Mertes et al.
6,605,156 B1 8/2003 Clark et al.
6,615,885 B1 9/2003 Ohm
6,625,843 B2 9/2003 Kim et al.
6,671,592 B1 12/2003 Bisset et al.
6,690,134 B1 2/2004 Jones et al.
6,742,220 B2 6/2004 Nagai et al.
6,781,338 B2 8/2004 Jones et al.
6,809,490 B2 10/2004 Jones et al.
6,841,963 B2 1/2005 Song et al.
6,845,297 B2 1/2005 Allard
6,883,201 B2 4/2005 Jones et al.
6,965,209 B2 11/2005 Jones
6,999,850 B2 2/2006 McDonald
D518,258 S 3/2006 Hamm et al.
7,027,893 B2 4/2006 Perry et al.
7,085,623 B2 8/2006 Sigers
7,147,238 B2 12/2006 Oi
7,155,308 B2 12/2006 Jones
7,159,276 B2 1/2007 Omoto et al.
7,171,723 B2 2/2007 Kobayashi et al.
7,173,391 B2 2/2007 Jones et al.
7,174,238 B1 2/2007 Zweig
7,193,384 B1 3/2007 Norman et al.
7,196,487 B2 3/2007 Jones et al.
7,228,202 B2 6/2007 Carlson et al.
7,248,951 B2 7/2007 Hulden
7,283,892 B1 10/2007 Boillot et al.
7,360,277 B2 4/2008 Moshenrose et al.
7,363,108 B2 4/2008 Noda et al.
7,389,166 B2 6/2008 Harwig et al.
7,424,611 B2 9/2008 Hino et al.
7,441,298 B2 10/2008 Svendsen et al.
7,444,206 B2 10/2008 Abramson et al.
7,448,113 B2 11/2008 Jones et al.
7,474,941 B2 1/2009 Kim et al.
7,503,096 B2 3/2009 Lin
7,553,123 B2 6/2009 Casaro
7,555,363 B2 6/2009 Augenbraun et al.
7,571,511 B2 8/2009 Jones et al.
7,578,020 B2 8/2009 Jaworski et al.
7,603,744 B2 10/2009 Reindel
7,617,557 B2 11/2009 Reindel
7,620,476 B2 11/2009 Morse et al.
7,636,982 B2 12/2009 Jones et al.
7,784,139 B2 8/2010 Sawalski et al.
7,849,555 B2 12/2010 Hahm et al.
7,953,526 B2 5/2011 Durkos et al.
8,020,245 B2 9/2011 Whittaker
D647,265 S 10/2011 Follows et al.
8,104,524 B2 1/2012 Manesh et al.
8,239,992 B2 8/2012 Schnittman et al.
8,316,503 B2 11/2012 Follows et al.
8,387,193 B2 3/2013 Ziegler et al.
8,392,021 B2 3/2013 Konandreas et al.
D680,287 S 4/2013 Morgan et al.
D680,289 S 4/2013 Gray et al.
D681,291 S 4/2013 Morgan et al.
D699,010 S 2/2014 Gilbert, Jr. et al.
8,661,605 B2 3/2014 Svendsen et al.

(56) References Cited

U.S. PATENT DOCUMENTS

| | | | | |
|---|---|---|---|---|
| D716,510 | S | 10/2014 | Gilbert | |
| 8,881,339 | B2 | 11/2014 | Gilbert, Jr. et al. | |
| 8,910,342 | B2 | 12/2014 | Gilbert, Jr. et al. | |
| 8,955,192 | B2 | 2/2015 | Gilbert, Jr. et al. | |
| D728,877 | S * | 5/2015 | Therrien | D32/31 |
| 9,173,534 | B2 | 11/2015 | Ando et al. | |
| 9,220,386 | B2 | 12/2015 | Gilbert, Jr. et al. | |
| 9,320,400 | B2 | 4/2016 | Gilert, Jr. et al. | |
| 9,326,654 | B2 | 5/2016 | Doughty | |
| 9,351,619 | B2 | 5/2016 | Bosses | |
| D774,263 | S * | 12/2016 | Reichel | D32/31 |
| 10,292,560 | B2 | 5/2019 | Doughty | |
| 10,595,624 | B2 | 3/2020 | Blouin et al. | |
| 11,109,727 | B2 | 9/2021 | Burbank et al. | |
| 2002/0016649 | A1 | 2/2002 | Jones | |
| 2002/0081937 | A1 | 6/2002 | Yamada et al. | |
| 2002/0120364 | A1 | 8/2002 | Colens | |
| 2002/0169521 | A1 | 11/2002 | Goodman et al. | |
| 2002/0189871 | A1 | 12/2002 | Won et al. | |
| 2003/0025472 | A1 | 2/2003 | Jones et al. | |
| 2003/0120389 | A1 | 6/2003 | Abramson et al. | |
| 2003/0120839 | A1 | 6/2003 | Abramson et al. | |
| 2003/0159240 | A1 | 8/2003 | Mertes et al. | |
| 2004/0020000 | A1 | 2/2004 | Jones | |
| 2004/0045125 | A1 | 3/2004 | Park et al. | |
| 2004/0049877 | A1 | 3/2004 | Jones et al. | |
| 2004/0074028 | A1 | 4/2004 | Goff | |
| 2004/0074038 | A1 | 4/2004 | Im | |
| 2004/0098167 | A1 | 5/2004 | Yi et al. | |
| 2004/0187249 | A1 | 9/2004 | Jones et al. | |
| 2004/0204792 | A1 | 10/2004 | Taylor et al. | |
| 2004/0211444 | A1 | 10/2004 | Taylor et al. | |
| 2004/0216265 | A1 | 11/2004 | Peacock et al. | |
| 2004/0236468 | A1 | 11/2004 | Taylor et al. | |
| 2004/0244138 | A1 | 12/2004 | Taylor et al. | |
| 2005/0010331 | A1 | 1/2005 | Taylor et al. | |
| 2005/0015914 | A1 | 1/2005 | You et al. | |
| 2005/0021181 | A1 | 1/2005 | Kim et al. | |
| 2005/0076466 | A1 | 4/2005 | Yan | |
| 2005/0181968 | A1 | 8/2005 | Policicchio et al. | |
| 2005/0183229 | A1 | 8/2005 | Uehigashi | |
| 2005/0204717 | A1 | 9/2005 | Colens | |
| 2005/0217042 | A1 | 10/2005 | Reindle | |
| 2005/0229340 | A1 | 10/2005 | Sawalski et al. | |
| 2005/0246857 | A1 | 11/2005 | Omoto et al. | |
| 2006/0020369 | A1 | 1/2006 | Taylor et al. | |
| 2006/0053584 | A1 | 3/2006 | Dever | |
| 2006/0064828 | A1 | 3/2006 | Stein et al. | |
| 2006/0196003 | A1 | 9/2006 | Song et al. | |
| 2006/0236500 | A1 | 10/2006 | Oh et al. | |
| 2007/0006404 | A1 | 1/2007 | Cheng et al. | |
| 2007/0074038 | A1 | 3/2007 | Arenburg et al. | |
| 2007/0095367 | A1 | 5/2007 | Wang et al. | |
| 2007/0136981 | A1 | 6/2007 | Dilger et al. | |
| 2007/0137153 | A1 | 6/2007 | Oh et al. | |
| 2007/0244610 | A1 | 10/2007 | Ozick et al. | |
| 2007/0266508 | A1 | 11/2007 | Jones et al. | |
| 2008/0052846 | A1 | 3/2008 | Kapoor et al. | |
| 2008/0058987 | A1 | 3/2008 | Ozick et al. | |
| 2008/0091304 | A1 | 4/2008 | Ozick et al. | |
| 2008/0244852 | A1 | 10/2008 | Alton | |
| 2008/0276407 | A1 | 11/2008 | Schnittman et al. | |
| 2008/0276408 | A1 | 11/2008 | Gilbert, Jr. et al. | |
| 2008/0279407 | A1 | 11/2008 | Schnittman et al. | |
| 2008/0282494 | A1 | 11/2008 | Won et al. | |
| 2008/0307590 | A1 | 12/2008 | Jones et al. | |
| 2008/0307597 | A1 | 12/2008 | Davidshofer et al. | |
| 2010/0037418 | A1 | 2/2010 | Hussey et al. | |
| 2010/0049365 | A1 | 2/2010 | Jones et al. | |
| 2010/0257690 | A1 | 10/2010 | Jones et al. | |
| 2010/0257691 | A1 | 10/2010 | Jones et al. | |
| 2010/0263158 | A1 | 10/2010 | Jones et al. | |
| 2010/0287717 | A1 | 11/2010 | Jang et al. | |
| 2010/0306956 | A1 | 12/2010 | Follows et al. | |
| 2010/0306958 | A1* | 12/2010 | Follows | A47L 9/0466 15/383 |
| 2010/0313910 | A1 | 12/2010 | Lee et al. | |
| 2011/0126375 | A1 | 6/2011 | Yan | |
| 2011/0162160 | A1 | 7/2011 | Whittaker | |
| 2012/0079670 | A1 | 4/2012 | Yoon et al. | |
| 2012/0090126 | A1 | 4/2012 | Kim et al. | |
| 2012/0159725 | A1 | 6/2012 | Kapoor et al. | |
| 2012/0199006 | A1 | 8/2012 | Swett | |
| 2013/0205520 | A1 | 8/2013 | Kapoor et al. | |
| 2014/0157542 | A1 | 6/2014 | Morphey et al. | |
| 2014/0259475 | A1* | 9/2014 | Doughty | A47L 9/04 15/207.2 |
| 2014/0259522 | A1* | 9/2014 | Kasper | A47L 9/1683 15/383 |
| 2016/0166127 | A1* | 6/2016 | Lewis | A47L 9/02 15/49.1 |
| 2016/0213217 | A1* | 7/2016 | Doughty | A47L 11/32 |
| 2016/0278595 | A1* | 9/2016 | Shim | A47L 9/0477 |
| 2017/0135544 | A1* | 5/2017 | Hong | A47L 11/4013 |
| 2017/0150859 | A1 | 6/2017 | Muir | |
| 2017/0296023 | A1* | 10/2017 | Qiao | A47L 9/2847 |
| 2018/0168417 | A1* | 6/2018 | Goddard | A47L 11/4013 |
| 2018/0255991 | A1* | 9/2018 | Der Marderosian | A47L 11/4041 |
| 2019/0029409 | A1* | 1/2019 | Blouin | A47L 9/0477 |
| 2019/0104900 | A1 | 4/2019 | Li | |
| 2019/0208971 | A1* | 7/2019 | O'Brien | A47L 11/4041 |
| 2019/0282054 | A1* | 9/2019 | Lee | A47L 9/009 |
| 2019/0298132 | A1* | 10/2019 | Lee | A47L 9/2805 |
| 2019/0307302 | A1* | 10/2019 | Zheng | A47L 9/0477 |
| 2020/0129030 | A1* | 4/2020 | Goddard | A47L 11/4044 |
| 2020/0275812 | A1* | 9/2020 | Burbank | A47L 9/0411 |

FOREIGN PATENT DOCUMENTS

| | | |
|---|---|---|
| CN | 1929770 | 3/2007 |
| CN | 1931613 | 3/2007 |
| CN | 101076276 | 11/2007 |
| CN | 102046060 | 5/2011 |
| CN | 204950812 | 1/2016 |
| CN | 205514379 | 8/2016 |
| CN | 106889946 | 6/2017 |
| CN | 108209771 | 6/2018 |
| DE | 4112382 | 10/1992 |
| DE | 4112382 A1 * | 10/1992 |
| DE | 4400956 | 10/1994 |
| DE | 10 2012208685 | 11/2013 |
| EP | 0 051 996 | 5/1982 |
| EP | 1 228 734 | 8/2002 |
| EP | 1228734 | 8/2002 |
| EP | 1 428 468 | 6/2004 |
| EP | 3245927 | 11/2017 |
| GB | 2262433 | 6/1993 |
| GB | 2344863 | 6/2000 |
| GB | 2446817 | 8/2008 |
| GB | 157616 | 1/2021 |
| JP | S48-039574 | 11/1973 |
| JP | S56-044545 | 3/1981 |
| JP | 55104929 | 4/1982 |
| JP | S62-061659 | 4/1987 |
| JP | H01-092960 | 6/1989 |
| JP | 05049566 | 3/1993 |
| JP | 06007271 | 1/1994 |
| JP | 06014853 | 1/1994 |
| JP | H06-59578 U | 8/1994 |
| JP | 08173355 | 7/1996 |
| JP | H09-263140 A | 10/1997 |
| JP | 11-187994 | 7/1999 |
| JP | 11216084 | 8/1999 |
| JP | 2000354567 | 12/2000 |
| JP | 2002112931 | 4/2002 |
| JP | 2002345698 | 12/2002 |
| JP | 2003000484 | 1/2003 |
| JP | 2003290092 | 10/2003 |
| JP | 2003290093 | 10/2003 |
| JP | 2004121795 | 4/2004 |
| JP | 2004261539 | 9/2004 |

(56) References Cited

FOREIGN PATENT DOCUMENTS

| | | | | |
|---|---|---|---|---|
| JP | 2006034996 | | 2/2006 | |
| JP | 2006149455 | | 6/2006 | |
| JP | 2006325761 | | 12/2006 | |
| JP | 2007167617 | | 7/2007 | |
| JP | 2007185228 | | 7/2007 | |
| JP | 2007-131090 | | 10/2007 | |
| JP | D1313090 | | 10/2007 | |
| JP | 05146382 | | 1/2008 | |
| JP | 2008000382 | | 1/2008 | |
| JP | D1339877 | | 9/2008 | |
| JP | 2009017902 | | 1/2009 | |
| JP | 2010035604 | | 2/2010 | |
| JP | 2010284529 | | 12/2010 | |
| JP | 2011016011 | | 1/2011 | |
| JP | 2011050428 | | 3/2011 | |
| JP | 2011115541 | | 6/2011 | |
| JP | 2011188951 | | 9/2011 | |
| JP | 2012-096042 | A | 5/2012 | |
| JP | 2013-045463 | A | 3/2013 | |
| JP | 2015520639 | | 7/2015 | |
| JP | 2020517340 | | 6/2020 | |
| KR | 20000002306 | | 1/2000 | |
| KR | 20090038965 | | 4/2009 | |
| KR | 20090084227 | | 8/2009 | |
| KR | 20110125942 | | 11/2011 | |
| KR | 20130021212 | | 3/2013 | |
| WO | WO 1995/016382 | | 6/1995 | |
| WO | WO-02058527 | A1 * | 8/2002 | ..... A47L 9/00 |
| WO | WO 2005/107563 | | 11/2005 | |
| WO | WO 2007/065033 | | 6/2007 | |
| WO | WO 2009/117383 | | 9/2009 | |
| WO | WO 2009/149722 | | 12/2009 | |
| WO | WO 2011/020040 | | 2/2011 | |
| WO | WO 2011/121816 | | 10/2011 | |
| WO | WO 2016/123345 | | 8/2016 | |
| WO | WO-2016123345 | A1 * | 8/2016 | ..... A47L 5/30 |
| WO | WO 2018/111279 | | 6/2018 | |
| WO | WO-2019023337 | A1 * | 1/2019 | ..... A64B 13/003 |

OTHER PUBLICATIONS

International Search Report and Written Opinion in International Appln. No. PCT/US2020/12336, dated Apr. 27, 2020, 14 pages.
International Preliminary Report on Patentability in International Appln. No. PCT/US2020/12336, dated Sep. 10, 2021, 12 pages.
Extended European Search Report in European Appln. No. 20763803.2, dated Jun. 12, 2023, 7 pages.

* cited by examiner

CLEANING ROLLERS FOR CLEANING ROBOTS

CROSS-REFERENCE TO RELATED APPLICATIONS

This application is a continuation application of, and claims priority to, U.S. patent application Ser. No. 16/288,699, now U.S. Pat. No. 11/109,727, filed on Feb. 28, 2019. The disclosure of the foregoing application is incorporated herein by reference in its entirety for all purposes.

TECHNICAL FIELD

This specification relates to cleaning rollers, in particular, for cleaning robots.

BACKGROUND

An autonomous cleaning robot can navigate across a floor surface and avoid obstacles while vacuuming the floor surface and operating rotatable members carried by the robot to ingest debris from the floor surface. As the robot moves across the floor surface, the robot can rotate the rotatable members, which engage the debris and guide the debris toward a vacuum airflow generated by the robot. The rotatable members and the vacuum airflow can thereby cooperate to allow the robot to ingest debris.

SUMMARY

A cleaning roller for an autonomous cleaning robot can be rotated during a cleaning operation of the robot such that the roller engages and picks up debris from a floor surface as the robot moves across the floor surface. The roller includes a vane configured to sweep across the floor surface as the roller rotates. The vane can include multiple interconnected portions forming at least one bend. For example, a first portion of the vane can extend in a first direction, and a second portion of the vane attached to the first portion can extend in a second direction different from the first direction.

Advantages of the cleaning rollers, cleaning heads, and cleaning robots described herein may include, but are not limited to, those described below and herein elsewhere.

Implementations of the vane of the roller can improve a debris pickup capability of the robot. For example, a bend in the vane can allow the vane, as the roller rotates and engages the floor surface, to sweep across the floor surface for a distance greater than a vane that extends radially outward along a radial axis and that does not have a bend. The bend in the vane can also allow angular deflection of the vane to be countered by a rotation of the roller, thus allowing the vane to maintain an orientation relative to the floor surface as the vane sweeps across the floor surface. The robot can include multiple vanes to further improve its debris pickup capability. In some implementations, a tip portion of the vane can include surface features to improve the debris pickup capability of the vane. Convex or concave features along the tip portion can allow the vane to contact the floor surface with a greater amount of force to agitate debris on the floor surface and thereby enable the debris to be more easily drawn into the robot with a flow of air using a vacuum system of the robot. Helical paths for the vane along the cleaning roller can cause debris swept up by the vane to travel toward a center of the roller. These helical paths can thus allow mechanical agitation of the debris to cooperate with airflow generated by a vacuum assembly of the robot, and in particular, can cause the debris to move toward a region of the roller where a force of the airflow generated by the vacuum assembly is greatest.

The roller can further be configured to improve a mobility of the robot. For example, the roller can be symmetric about a central axial plane of the roller. Such symmetry can reduce the tendency of the roller to produce a lateral force on the robot as the robot moves along the floor surface and as the roller contacts the floor surface. As a result, the roller is less likely to cause the robot to drift, for example, leftward or rightward as the robot moves in a forward drive direction. The vane of the roller can also be configured to improve the mobility of the robot. The vane can be sufficiently flexible to reduce the likelihood that the vane affects a direction of movement of the robot as the vane contacts the floor surface. In some implementations, the roller can include features that enable the roller to assist the robot to move over obstacles on the floor surface. For example, the roller can include a nub extending from the cleaning roller that engages with an obstacle on the floor surface. The nub can be sufficiently stiff to allow the roller to engage the obstacle and lift the robot above the obstacle, thus enabling the robot to move over the obstacle.

The roller can further include features that reduce an amount of noise produced by the roller as the roller contacts the floor surface. The vane can extend along a helical path along a surface of the cleaning roller, and such a configuration can reduce the amount of noise produced by the roller. In some implementations, the first and second portions of the vane are shaped to reduce a stiffness of the vane and thus mitigate noise. The roller can further include one or more openings along the vane that can further serve as noise mitigation features. The roller can include, for example, one or more openings along the vane to reduce a stiffness of the roller at various locations along the roller, e.g., at the center of the roller, at quarter-points along the roller, or at other locations along the roller. The reduced stiffness of the roller can further reduce noise produced by the roller as the roller contacts objects, e.g., the floor surface or debris.

The roller can include features to reduce a susceptibility of the vane to wear. For example, the interface between the vane of the roller and an elongate member to which the vane is attached can reduce the susceptibility of the vane to wear. For example, the vane can extend tangentially from the elongate member, thus reducing the likelihood of stress concentrations in the vicinity of where the vane is attached to the elongate member.

In one aspect, a cleaning roller mountable to a cleaning robot is featured. The cleaning roller includes an elongate member extending along a longitudinal axis of the cleaning roller, and a vane extending outward from the elongate member. The vane includes a first vane portion attached to the elongate member, and a second vane portion attached to the first vane portion. The first vane portion extends from the elongate member at a location intersecting a radial axis of the cleaning roller. The first vane portion extends along a first axis angled relative to the radial axis and away from the radial axis in a tangential direction. The second vane portion extends along a second axis angled relative to the first axis. A first angle between the first axis and the radial axis is greater than a second angle between the second axis and the radial axis.

In another aspect, a cleaning head for a vacuum cleaner is featured. The cleaning head includes a conduit and a cleaning roller configured to sweep debris into the conduit. The cleaning roller includes an elongate member extending along a longitudinal axis of the cleaning roller, and a vane extending outward from the elongate member. The vane includes a first vane portion attached to the elongate member, and a second vane portion attached to the first vane portion. The first vane portion extends from the elongate member at a location intersecting a radial axis of the cleaning roller. The first vane portion extends along a first axis angled relative to the radial axis and away from the radial axis in a tangential direction. The second vane portion extends along a second axis angled relative to the first axis. A first angle between the first axis and the radial axis is greater than a second angle between the second axis and the radial axis.

In another aspect, a cleaning robot includes a drive system to move the robot across a floor surface, and a cleaning roller mountable to a cleaning robot. The cleaning roller is rotatable about a longitudinal axis of the cleaning roller in a first rotational direction. The cleaning roller includes an elongate member extending along the longitudinal axis of the cleaning roller, and a vane extending outward from the elongate member. The vane includes a first vane portion attached to the elongate member, and a second vane portion attached to the first vane portion. The first vane portion extends from the elongate member at a location intersecting a radial axis of the cleaning roller. The first vane portion extends along a first axis angled relative to the radial axis and away from the radial axis in a tangential direction. The second vane portion extends along a second axis angled relative to the first axis. A first angle between the first axis and the radial axis is greater than a second angle between the second axis and the radial axis.

In some implementations, the vane can include a first vane, and the cleaning roller can include multiple vanes including at least the first vane and a second vane. The second vane can extend outward from the shell away from the longitudinal axis of the cleaning roller and offset from the first vane in the tangential direction.

In some implementations, the cleaning roller can include multiple vanes including the first vane and the second vane. Each of the multiple vanes can be symmetric about a plane. The plane can be located at a center of the cleaning roller and perpendicular to the longitudinal axis of the cleaning roller. In further implementations, the radial axis can be a first radial axis, and the second vane can be attached to the shell at a location intersecting a second radial axis of the cleaning roller. The first and second radial axes can form an angle between 30 and 90 degrees.

In some implementations, the elongate member can be cylindrical. The first axis can extend tangentially from a circumference of the elongate member.

In some implementations, the tangential direction can be a second tangential direction. The second vane portion can include a first surface facing in a first tangential direction and a second surface facing in the second tangential direction. The first and second surfaces can be positioned between a tip of the second vane portion and the first vane portion, and the first surface can be curved. In further implementations, the first surface can be concave. In further implementations, the first surface can be convex.

In some implementations, the radial axis can be a first radial axis, and the second vane portion can extend through a second radial axis of the cleaning roller. The second axis can form an angle no more than 5 degrees with the second radial axis.

In some implementations, a segment of the vane can extend along a helical path along the elongate member. In further implementations, the helical path can be a first helical path, and the segment of the vane can be a first segment of the vane. A second segment of the vane can extend along a second helical path along the elongate member. In further implementations, the first helical path can extend from a first end of the first helical path to a second end of the first helical path along the elongate member in the tangential direction of the cleaning roller. The first end of the first helical path can be positioned proximate a first longitudinal end portion of the cleaning roller, and the second end of the first helical path can be positioned proximate a center of the cleaning roller. The second helical path can extend from a first end of the second helical path to a second end of the second helical path along the elongate member in the tangential direction of the cleaning roller. The first end of the second helical path can be positioned proximate a second longitudinal end portion of the cleaning roller, and the second end of the second helical path can be positioned proximate the center of the cleaning roller. In further implementations, the first helical path can be symmetric to the second helical path about a plane. The plane can be located at a center of the cleaning roller and perpendicular to the longitudinal axis of the cleaning roller. In further implementations, a pitch of the helical path can be between 300 and 900 millimeters.

In some implementations, the cleaning roller can further include a nub extending outward from the elongate member away from the longitudinal axis. A height of an outer tip of the vane relative to the elongate member can be greater than a height of an outer tip of the nub relative to the shell. In further implementations, the nub can have a maximum thickness between 8 and 18 millimeters. In further implementations, the nub can taper from the elongate member to the outer tip of the nub. In further implementations, the nub can be a first nub, and the cleaning roller further can include a second nub extending outward from the elongate member away from the longitudinal axis. The vane can be positioned between the first nub and the second nub. In further implementations, a height of the outer tip of the nub relative to the elongate member can be between 0.25 and 2.0 centimeters.

In some implementations, the vane can include an opening extending along a central portion of the cleaning roller. The opening can extend only partially through the vane away from the elongate member toward an outer tip of the vane. In further implementations, the opening can extend from the elongate member toward the outer tip of the vane. In further implementations, the opening can taper toward the outer tip of the vane. In further implementations, the opening can include a maximum width between 2 and 8 millimeters. In further implementations, the first vane portion can include a first segment extending from a first longitudinal end portion of the cleaning roller toward the central portion of the cleaning roller and a second segment extending from a second longitudinal end portion of the cleaning roller toward the central portion of the cleaning roller. The first segment of the first vane portion can be separated from the second segment of the first vane portion by the opening, and the second vane portion can extend continuously along the vane from the first longitudinal end portion of the cleaning roller to the second longitudinal end portion of the cleaning roller.

In some implementations, the vane can be a first vane, and the cleaning roller can further include a second vane. The first vane can include a first longitudinal end proximate a first longitudinal end of the cleaning roller and a second longitudinal end proximate a center of the cleaning roller. The second vane can include a first longitudinal end proximate a second longitudinal end of the cleaning roller and a second longitudinal end proximate the center of the cleaning roller. The second longitudinal end of the first vane can be separated from the second longitudinal end of the second vane.

In some implementations, an outer diameter of the cleaning roller can be uniform across a length of the cleaning roller. The outer diameter can be defined at least in part by the vane.

In some implementations, the elongate member can be cylindrical across a length of the cleaning roller.

In some implementations, the first vane portion can include a first end attached to the elongate member and a second end attached to the second vane portion. A first radial distance between the first end of the first vane portion and the longitudinal axis of the cleaning roller can be 50% to 90% of a second radial distance between the second end of the first vane portion and the longitudinal axis of the cleaning roller.

In some implementations, a length from a first end of the second vane portion to a second end of the second vane portion can be 25% to 75% of a length from a first end of the first vane portion to a second end of the first vane portion.

In some implementations, a first length from a first end of the first vane portion to a second end of the first vane portion can be between 0.5 and 3 centimeters. A second length from a first end of the second vane portion to a second end of the second vane portion can be between 0.2 and 1.5 centimeters.

In some implementations, a thickness of the first vane portion can be between 0.5 and 4 millimeters.

In some implementations, a maximum thickness of the second vane portion can be between 2 and 5 millimeters.

In some implementations, an overall diameter of the cleaning roller can be between 30 and 90 millimeters, and an overall length of the cleaning roller is between 10 and 50 centimeters.

In some implementations, the vane can further include a third portion attached to the second vane portion. The third portion of the vane can extend along a third axis angled relative to the second axis. A third angle between the third axis and the radial axis can be less than the second angle between the second axis and the radial axis. In further implementations, the third portion of the vane can include a tip portion of the vane.

In another aspect, a cleaning roller mountable to a cleaning robot is featured. The cleaning roller includes an elongate member extending along a longitudinal axis of the cleaning roller, and a vane attached to the elongate member. The vane includes a first vane portion extending from a first end attached to the elongate member to a second end, a second vane portion extending from a first end attached to the second end of the first vane portion to a second end including a tip portion of the vane, and a bend where the second end of the first vane portion is attached to the first end of the second vane portion.

In some implementations, the first end of the first vane portion can be attached to the elongate member along a location intersecting a first radial axis of the cleaning roller, and the tip portion of the vane can be positioned along a second radial axis of the cleaning roller. In further implementations, an angle between the first radial axis and the second radial axis can be between 20 and 70 degrees. In further implementations, the first vane portion can extend along a first axis, and the second vane portion can extend along a second axis. An angle between the first axis and the first radial axis can be greater than an angle between the second axis and the first radial axis. In further implementations, an angle between the first axis and the second axis can be between 90 and 170 degrees.

In some implementations, a length of the second vane portion can be 25% to 75% of a length of the first vane portion.

In some implementations, the second vane portion can include a first surface facing a first tangential direction, and a second surface facing a second tangential direction. The first surface can include a convex portion. In further implementations, the convex portion of the first surface of the second vane portion can be connected to the first vane portion, and the first surface of the second vane portion further can include a concave portion connected to the convex portion. In further implementations, the first vane portion can include a first surface facing the first tangential direction and a second surface facing the second tangential direction. The first and second surfaces of the first vane portion can be parallel to one another.

In some implementations, the tip portion can be scoop-shaped.

In some implementations, a maximum thickness of the first vane portion can be between 1 and 4 millimeters. In further implementations, a maximum thickness of the second vane portion can be 10% to 75% greater than the maximum thickness of the first vane portion.

In some implementations, a height of the vane relative to the elongate member can be between 0.5 and 2.5 centimeters.

In another aspect, a cleaning roller mountable to a cleaning robot is featured. The cleaning roller includes an elongate member extending along a longitudinal axis of the cleaning roller, and a vane attached to the elongate member. The vane includes a first bend and a second bend. The first bend is positioned between the elongate member and the second bend, and the second bend is positioned between the first bend and a tip portion of the vane.

In some implementations, the vane can include a first vane portion extending outwardly from the elongate member, and a second vane portion extending outwardly from the first vane portion. The first vane portion can be attached to the second vane portion at the first bend. In further implementations, the vane can include a third vane portion extending outwardly from the second vane portion and terminating at the tip portion of the vane. The second vane portion can be attached to the third vane portion at the second bend. In further implementations, a length of the second vane portion can be 15% to 35% of a length the first vane portion. In further implementations, a length of the third vane portion can be 10% to 30% of the length of the first vane portion. In further implementations, the vane can be attached to the elongate member at a location intersecting a radial axis of the cleaning roller, the first vane portion can extend along a first axis, and the second vane portion can extend along a second axis. An angle between the first axis and the radial axis can be greater than an angle between the second axis and the radial axis. In further implementations, the third vane portion can extend along a third axis, and the angle between the second axis and the radial axis can be less than an angle between the third axis and the radial axis. In further implementations, an angle between the first axis and the second axis can be between 90 and 170 degrees. In further implementations, an angle between the second axis and the third axis can be between 90 and 170 degrees. In further implementations, an angle between the third axis and the first axis can be no more than 5 to 15 degrees.

In another aspect, a cleaning roller mountable to a cleaning robot is featured. The cleaning roller includes an elongate member extending along a longitudinal axis of the cleaning roller, and a vane attached to the elongate member.

The vane extends along a helical path extending longitudinally along the elongate member. The vane includes an opening extending along a central portion of the cleaning roller.

In some implementations, the opening can include a slit.

In some implementations, the opening can extend away from the elongate member toward an outer tip of the vane. The opening can taper toward an outer tip of the vane. In further implementations, the opening can include a maximum width between 2 and 8 millimeters. In further implementations, the opening can be symmetric about a central transverse plane of the cleaning roller.

In some implementations, the opening can extend only partially through the vane away from the elongate member toward an outer tip of the vane. In further implementations, the opening can extend from the elongate member toward the outer tip of the vane.

In some implementations, the vane can include a first vane portion, a second vane portion, and a bend where the first vane portion is attached to the second vane portion. The opening can extend through an entire length the first vane portion. In further implementations, a distal termination point of the opening can be coincident with a location where the first vane portion is attached to the second vane portion. In further implementations, the vane can extend along an entire length of the elongate member. In further implementations, the first vane portion can include a first segment and a second segment. The first segment can be separated from the second segment by the opening. In further implementations, the second vane portion can extend continuously along the entire length of the elongate member.

In another aspect, a cleaning roller mountable to a cleaning robot is featured. The cleaning roller includes an elongate member extending along a longitudinal axis of the cleaning roller, a vane attached to the elongate member, and a nub attached to the elongate member. The nub extends outwardly from the elongate member. A height of the nub above the elongate member is less than a height of the vane above the elongate member.

In some implementations, the vane can be deflectable, and the nub can be a rigid protrusion.

In some implementations, the nub can taper from the elongate member to a tip portion of the nub.

In some implementations, the nub can be a substantially triangular protrusion from the elongate member.

In some implementations, the height of the nub above the elongate member can be between 0.25 and 2.0 centimeters. In further implementations, the height of the vane can be 25% to 100% greater than the height of the nub.

In some implementations, the nub can include a first surface facing a first tangential direction of the cleaning roller and a second surface facing a second tangential direction of the cleaning roller. A length of the first surface can be greater than a length of the second surface. In further implementations, the length of the first surface can be 1.5 to 2.5 times longer than the length of the second surface.

In some implementations, a maximum thickness of the nub can be between 8 and 18 millimeters.

In some implementations, the vane can be a first vane attached to the elongate member, and the cleaning roller can further include a second vane. The nub can be positioned between the first vane and the second vane.

In some implementations, the nub can extend longitudinally and circumferentially along the elongate member along a helical path along the elongate member.

In another aspect, a cleaning roller mountable to a cleaning robot is featured. The cleaning roller includes an elongate member extending along a longitudinal axis of the cleaning roller, a vane attached to the elongate member, and a nub attached to the elongate member. The nub can extend outwardly from the elongate member and can include an opening to receive a bristle brush.

In some implementations, the opening can extend radially inwardly from a surface of the nub.

In some implementations, the opening can include a rectangular portion.

In some implementations, a first portion of the vane can extend outwardly and in a tangential direction, and the opening can face the tangential direction.

In some implementations, a height of the nub relative to the elongate member can be less than a height of the vane relative to the elongate member.

In some implementations, the opening can include a first portion adjacent to surfaces of the nub, and a second portion adjacent to the first portion of the opening. In further implementations, a width of the first portion of the opening can be less than a width of the second portion of the opening. In further implementations, the width of the first portion can be between 1 and 4 millimeters. In further implementations, the width of the second portion can be 1.5 to 2.5 time longer than the width of the first portion.

In another aspect, a cleaning robot includes a drive system to move the robot across a floor surface, and a cleaning roller in accordance with any of the example cleaning rollers described herein. In some implementations, cleaning robot includes another cleaning roller in accordance with any of the example cleaning rollers described herein.

The details of one or more implementations of the subject matter described in this specification are set forth in the accompanying drawings and the description below. Other potential features, aspects, and advantages will become apparent from the description, the drawings, and the claims.

DETAILED DESCRIPTION

Figure 1A:
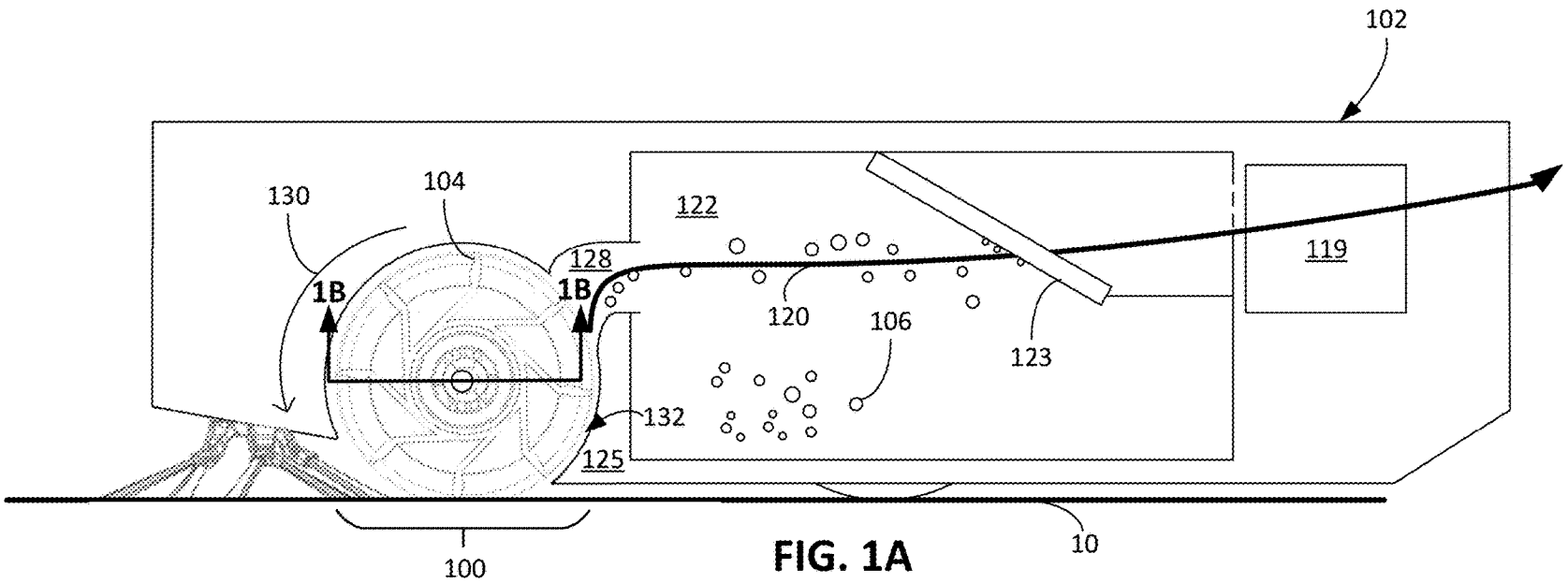
FIG. 1A is a cross-sectional schematic side view of a cleaning robot during a cleaning operation.

FIG. 1A is a cross-sectional side view of a cleaning robot 102 during a cleaning operation. During the cleaning operation, the cleaning robot 102 can clean a floor surface 10. A cleaning head 100 for the cleaning robot 102 includes one or more rotatable members, e.g., a cleaning roller 104, that is positioned to engage debris 106 on the floor surface 10. The robot 102 moves about the floor surface 10 while rotating the roller 104 and operating a vacuum assembly 119 to ingest the debris 106 from the floor surface 10. During the cleaning operation, the roller 104 rotates to lift the debris 106 from the floor surface 10 into the robot 102 while the robot 102 moves about the floor surface 10. The rotation of the roller 104 facilitates movement of the debris 106 toward an interior of the robot 102. An outer surface of the roller 104 contacts and engages the debris 106 and then directs the debris 106 toward the interior of the robot 102. The contact between the roller 104 and the debris 106 further agitates the debris 106, enabling the debris 106 to be more easily suctioned into the robot 102.

Figure 1B:
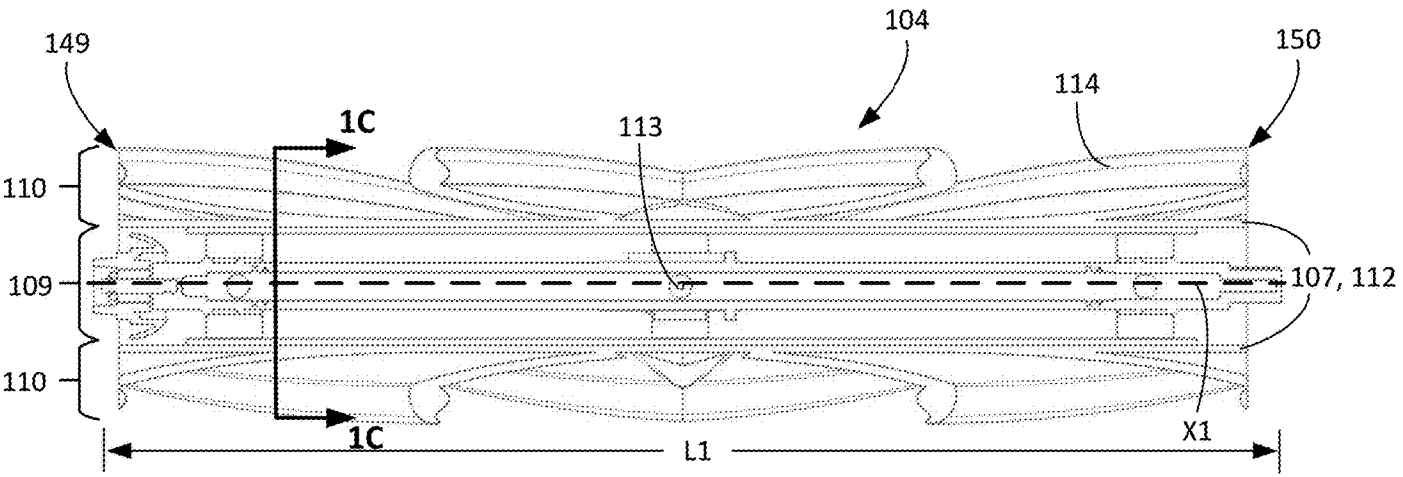
FIG. 1B is a cross-sectional bottom view of a cleaning roller of the robot taken along the section 1B-1B shown in FIG. 1A.

Referring to FIG. 1B, the roller 104 includes an elongate member 107 and a vane 114 extending outward from the elongate member 107 away from a longitudinal axis X1 of the roller 104. The elongate member 107 is a structural member extending along the longitudinal axis X1. In some implementations, the elongate member 107 extends from a first end portion 149 of the roller 104 to a second end portion 150 of the roller 104. In the example shown in FIG. 1B, the roller 104 includes a sheath 110 and a support structure 109 within the sheath 110. The sheath 110 includes a shell 112 and the vane 114. The elongate member 107 includes or corresponds to a shell 112 of the sheath 110.

Figure 1C:
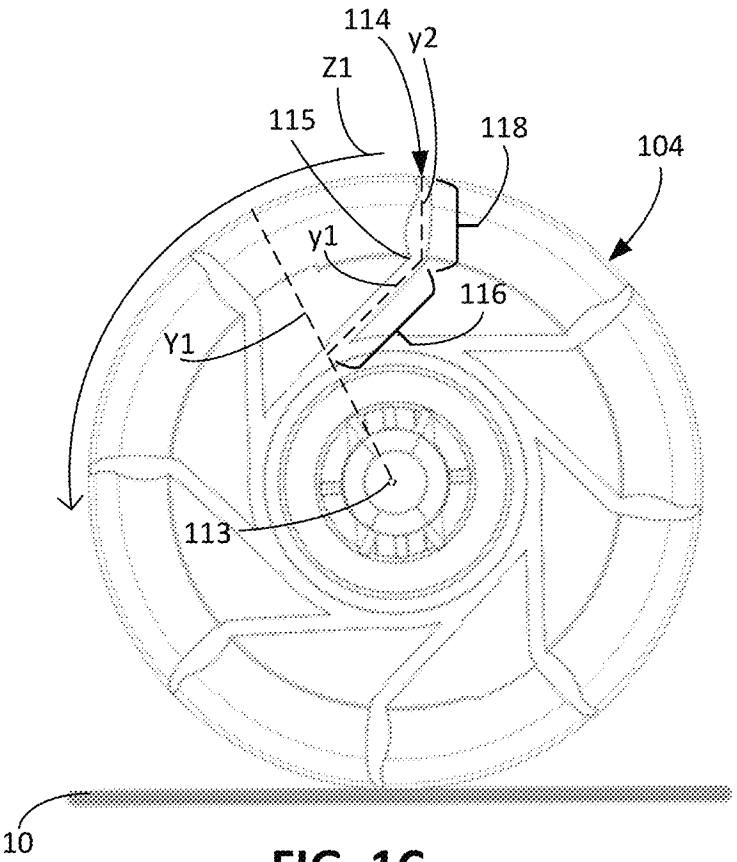
FIG. 1C is a cross-sectional side view, taken along the section 1C-1C shown in FIG. 1B, of the cleaning roller engaging a floor surface.

FIG. 1C depicts a side cross-sectional view of the roller 104, with a portion of the roller 104 engaging the floor surface 10. In particular, a portion of the vane 114 engages the floor surface 10 as the roller 104 rotates. Referring to FIG. 1C, the vane 114 includes a bend 115 where a first portion 116 of the vane 114 meets a second portion 118 of the vane 114. As described herein, such a configuration can reduce an amount of torque required to rotate the roller 104 and improve the debris pickup capability of the roller 104 and can thus allow the robot 102 (shown in FIG. 1A) to more efficiently clean the floor surface 10.

Example Cleaning Robots

Autonomous cleaning robots described herein are types of vacuum cleaners that can autonomous navigate around a floor surface. Referring to FIG. 1A, the robot 102 is an autonomous cleaning robot that autonomously traverses the floor surface 10 while ingesting the debris 106 from different parts of the floor surface 10. In the example depicted in FIGS. 1A and 2A, the robot 102 includes a body 200 movable across the floor surface 10. The body 200 includes, in some cases, multiple connected structures to which movable components of the robot 102 are mounted. For example, the connected structures forming the body 200 include an outer housing to cover internal components of the robot 102, a chassis to which drive wheels 210*a*, 210*b* and the roller 104 are mounted, a bumper mounted to the outer housing, a lid for an internal cleaning bin of the robot 102, etc.

Figure 2A:
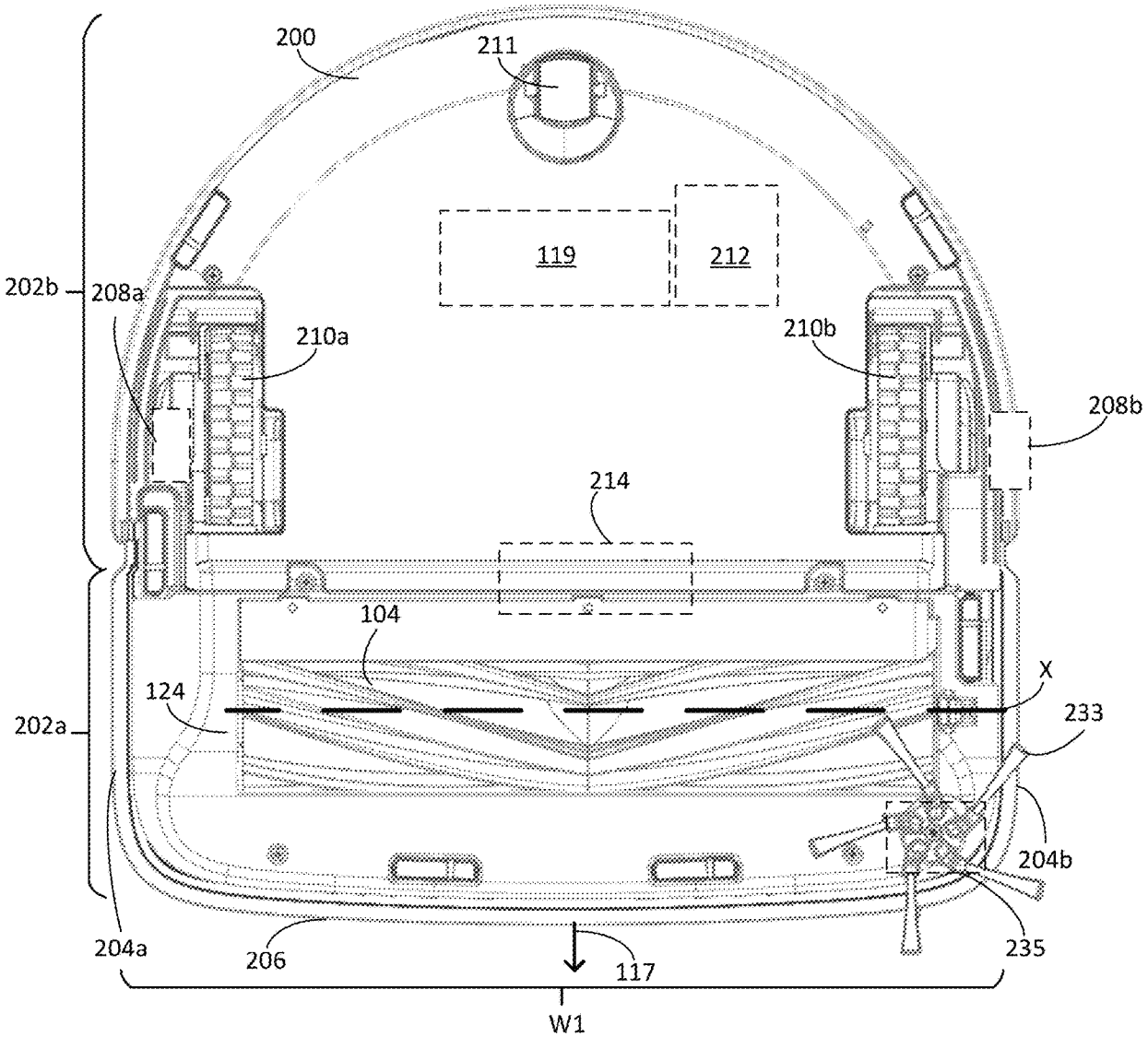
FIGS. 2A and 2B are bottom and bottom perspective exploded views, respectively, of the robot of FIG. 1A.

The body 200 includes a front portion 202*a* that has a substantially rectangular shape and a rear portion 202*b* that has a substantially semicircular shape. The front portion 202*a* is, for example, a front one-third to front one-half of the robot 102, and the rear portion 202*b* is a rear one-half to two-thirds of the robot 102. As shown in FIG. 2A, the front portion 202*a* includes two lateral sides 204*a*, 204*b* that are substantially perpendicular to a front side 206 of the front portion 202*a*. In some implementations, a width W1 of the robot 102, e.g., a distance between the two lateral sides 204*a*, 204*b*, is between 20 cm and 60 cm, e.g., between 20 cm and 40 cm, 30 cm and 50 cm, 40 cm and 60 cm, etc. 1

The robot 102 includes a drive system including actuators 208*a*, 208*b*, e.g., motors, operable with drive wheels 210*a*, 210*b*. The actuators 208*a*, 208*b* are mounted in the body 200 and are operably connected to the drive wheels 210*a*, 210*b*, which are rotatably mounted to the body 200. The drive wheels 210*a*, 210*b* support the body 200 above the floor surface 10. The actuators 208*a*, 208*b*, when driven, rotate the drive wheels 210*a*, 210*b* to enable the robot 102 to autonomously move across the floor surface 10.

The robot 102 includes a controller 212 that operates the actuators 208*a*, 208*b* to autonomously navigate the robot 102 about the floor surface 10 during a cleaning operation. The actuators 208*a*, 208*b* are operable to drive the robot 102 in a forward drive direction 117 (shown in FIG. 2A) and to turn the robot 102. In some implementations, the robot 102 includes a caster wheel 211 that supports the body 200 above the floor surface 10. For example, the caster wheel 211 supports the rear portion 202*b* of the body 200 above the floor surface 10, and the drive wheels 210*a*, 210*b* support the front portion 202*a* of the body 200 above the floor surface 10.

As shown in FIGS. 1A and 2A, the vacuum assembly 119 is carried within the body 200 of the robot 102, e.g., in the rear portion 202*b* of the body 200. Referring to FIG. 2A specifically, the controller 212 operates the vacuum assembly 119 to generate an airflow 120 that flows proximate the roller 104, through the body 200, and out of the body 200. For example, the vacuum assembly 119 includes an impeller that generates the airflow 120 when rotated. The vacuum assembly 119 generates the airflow 120 as the roller 104 rotates to ingest debris 106 into the robot 102. A cleaning bin 122 mounted in the body 200 is configured to store the debris 106 ingested by the robot 102. A filter 123 in the body 200 separates the debris 106 from the airflow 120 before the airflow 120 enters the vacuum assembly 119 and is exhausted out of the body 200. In this regard, the debris 106 is captured in both the cleaning bin 122 and the filter 123 before the airflow 120 is exhausted from the body 200.

As shown in FIG. 2A, the cleaning head 100 and the roller 104 are positioned in the front portion 202*a* of the body 200 between the lateral sides 204*a*, 204*b*. The roller 104 is operably connected to an actuation mechanism of the robot 102. In particular, the roller 104 is operably connected to an actuation mechanism including a drive mechanism connected to an actuator 214 of the robot 102 such that torque provided by the actuator 214 can be delivered to drive the roller 104. The cleaning head 100 and the roller 104 are positioned forward of the cleaning bin 122, which is positioned forward of the vacuum assembly 119. In the example of the robot 102 described with respect to FIG. 2A, the substantially rectangular shape of the front portion 202*a* of the body 200 enables the roller 104 to be longer than cleaning rollers for cleaning robots with, for example, a circularly shaped body.

The roller 104 is mounted to a housing 124 of the cleaning head 100 and mounted, e.g., indirectly or directly, to the body 200 of the robot 102. In particular, the roller 104 is mounted to an underside of the front portion 202*a* of the body 200 so that the roller 104 engages debris 106 on the floor surface 10 during the cleaning operation when the underside of the front portion 202*a* faces the floor surface 10. In some implementations, the housing 124 of the cleaning head 100 is mounted to the body 200 of the robot 102. In this regard, the roller 104 is also mounted to the body 200 of the robot 102, e.g., indirectly mounted to the body 200 through the housing 124. Alternatively or additionally, the cleaning head 100 is a removable assembly of the robot 102 in which the housing 124 with the roller 104 mounted therein is removably mounted to the body 200 of the robot 102. The housing 124 and the roller 104 are removable from the body 200 as a unit so that the cleaning head 100 is easily interchangeable with a replacement cleaning head.

In some implementations, rather than being removably mounted to the body 200, the housing 124 of the cleaning head 100 is not a component separate from the body 200, but rather, corresponds to an integral portion of the body 200 of the robot 102. The roller 104 is mounted to the body 200 of the robot 102, e.g., directly mounted to the integral portion of the body 200. The roller 104 is independently removable from the housing 124 of the cleaning head 100 and/or from the body 200 of the robot 102 so that the roller 104 can be easily cleaned or be replaced with a replacement roller. As described herein, the roller 104 can include collection wells for filament debris that can be easily accessed and cleaned by a user when the roller 104 is dismounted from the housing 124.

Referring to FIGS. 1A and 2A, the roller 104, when mounted to the housing 124, is positioned adjacent a dustpan 125 extending along the roller 104. In some implementations, the dustpan 125 extends along an entire length of the roller 104 or at least along 90% of the entire length of the roller 104. The dustpan 125 is positioned below at least a portion of the roller 104 and is positioned to receive debris 106 swept up by the roller 104. In this regard, the dustpan 125 can be positioned in a rotational direction of the roller 104 relative to a region that the roller 104 contacts the floor surface 10 such that any debris in the region contacting the roller 104 is swept onto the dustpan 125.

The roller 104 is rotatable relative to the housing 124 of the cleaning head 100 and relative to the body 200 of the robot 102. The roller 104 is rotatable about the longitudinal axis X1 of the roller 104. The longitudinal axis X1 can be parallel to the floor surface 10. In some cases, the longitudinal axis X1 is perpendicular to the forward drive direction 117 of the robot 102. Referring to FIGS. 1B and 1C, a center 113 of the roller 104 is positioned along the longitudinal axis X1 of the roller 104 and corresponds to a midpoint of a length L1 of the roller 104. The center 113, in this regard, is positioned along an axis of rotation of the roller 104. The length L1 of the roller 104 is between, for example, 10 cm and 50 cm, e.g., between 10 cm and 30 cm, 20 cm and 40 cm, 30 cm and 50 cm, 20 cm and 30 cm, 22 cm and 26 cm, 23 cm and 25 cm, or about 24 cm. The length L1 is, for example, between 70% and 90% of an overall width W1 of the robot 102, e.g., between 70% and 80%, 75% and 85%, and 80% and 90%, etc., of the overall width W1 of the robot 102.

Figure 2B:
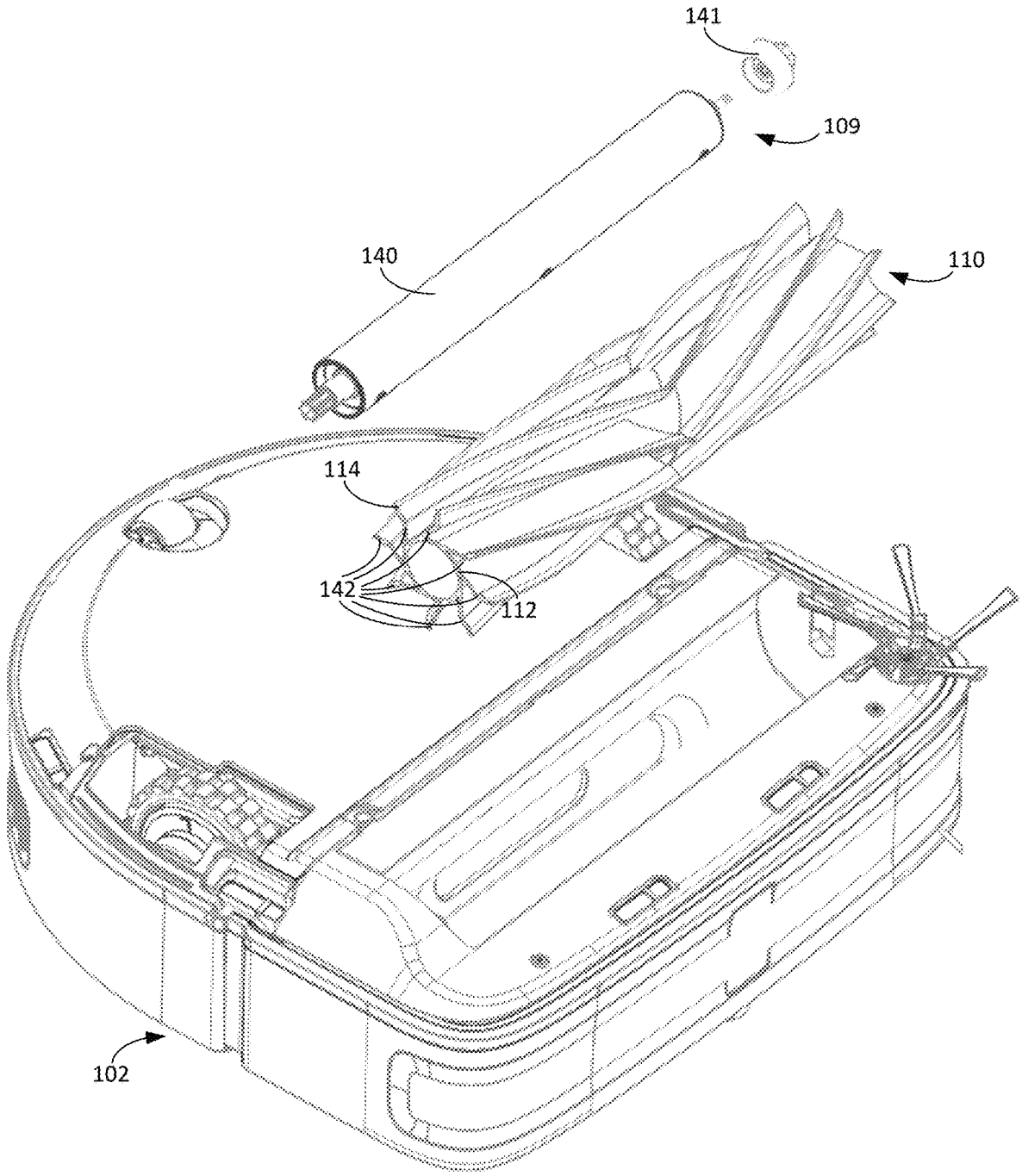

Referring to the exploded view of the cleaning head 100 shown in FIG. 2B, the roller 104 includes the elongate member 107 and the vane 114. In the example shown in FIG. 2B, the roller includes the sheath 110 and the support structure 109. The sheath 110 includes the shell 112 and the vane 114. The elongate member 107 can include or correspond to the shell 112 of the sheath 110. The support structure 109 includes a core 140 and an end cap 141 mounted to the core 140. The core 140 radially supports the sheath 110 and, in particular, the shell 112. The end cap 141 is mountable to the body 200 of the robot 102, thereby mounting the roller 104 to the robot 102.

In some implementations, the sheath 110 is a single molded piece formed from one or more elastomeric materials. The shell 112 and its corresponding vane 142 are part of a single molded piece. For example, the roller 104 is an elastomeric roller featuring a pattern vanes 142, e.g., including the vane 114, distributed along an exterior surface of the roller 104. The vanes 142 of the roller 104 make contact with the floor surface 10 along the length of the roller 104 and experience a consistently applied friction force during rotation that is not present with brushes having pliable bristles. In addition, the vanes 142 of the roller 104 can be designed to have a certain amount of stiffness that pliable bristles would not have. The vanes 142 can withstand some forces as the vanes 142 contact the floor surface 10 without buckling in response to the forces. In contrast, pliable bristles may buckle in response to the forces between the bristles and the floor surface 10. The high surface friction of the sheath 110 enables the sheath 110 to engage the debris 106 and guide the debris 106 toward the interior of the robot 102, e.g., toward an air conduit 128 (shown in FIG. 1A) within the robot 102.

Furthermore, like cleaning rollers having distinct bristles extending radially from a rod member, the roller 104 has the vanes 142 that extend radially outward. Unlike bristles, however, the vanes 142 extend continuously along the outer surface of the shell 112 in a longitudinal direction. The vanes 142 extend along tangential directions along the outer surface of the shell 112. Other suitable configurations, however, are also contemplated. For example, in some implementations, the roller 104 may include bristles, elongated pliable flaps, or a combination thereof for agitating the floor surface in addition or as an alternative to the vanes 142.

Referring to FIG. 2A, in some implementations, to sweep debris 106 toward the roller 104, the robot 102 includes a brush 233 that rotates about a non-horizontal axis, e.g., an axis forming an angle between 75 degrees and 90 degrees with the floor surface 10. The non-horizontal axis, for example, forms an angle between 75 degrees and 90 degrees with the longitudinal axis X1 of the roller 104. The robot 102 includes an actuator 235 operably connected to the brush 233. The brush 233 extends beyond a perimeter of the body 200 such that the brush 233 is capable of engaging debris 106 on portions of the floor surface 10 that the roller 104 typically cannot reach.

During the cleaning operation shown in FIG. 1A, as the controller 212 operates the actuators 208*a*, 208*b* to navigate the robot 102 across the floor surface 10, if the brush 233 is present, the controller 212 operates the actuator 235 to rotate the brush 233 about the non-horizontal axis to engage debris 106 that the roller 104 cannot reach. In particular, the brush 233 is capable of engaging debris 106 near walls of the environment and brushing the debris 106 toward the roller 104. The brush 233 sweeps the debris 106 toward the roller 104 so that the debris 106 can be engaged by the roller 104 and swept into the interior of the robot 102.

The controller 212 operates the actuator 214 to rotate the roller 104 about the longitudinal axis X1. The roller 104, when rotated, engages the debris 106 on the floor surface 10 and move the debris 106 toward the dustpan 125 and toward the air conduit 128. As shown in FIG. 1A, the roller 104 rotates in a counterclockwise direction 130 and sweeps debris on the floor surface 10 onto the dustpan 125 or into the air conduit 128

The controller 212 also operates the vacuum assembly 119 to generate the airflow 120. The vacuum assembly 119 is operated to generate the airflow 120 through a region 132 between the dustpan 125 and the roller 104 and can move the debris 106 swept up by the roller 104 onto the dustpan 125 as well as the debris 106 swept into the air conduit 128. The airflow 120 carries the debris 106 into the cleaning bin 122 that collects the debris 106 delivered by the airflow 120. In this regard, both the vacuum assembly 119 and the roller 104 facilitate ingestion of the debris 106 from the floor surface 10. The air conduit 128 receives the airflow 120 containing the debris 106 and guides the airflow 120 into the cleaning bin 122. The debris 106 is deposited in the cleaning bin 122. During rotation of the roller 104, the roller 104 applies a force to the floor surface 10 to agitate any debris on the floor surface 10. The agitation of the debris 106 can cause the debris 106 to be dislodged from the floor surface 10 so that the roller 104 can more easily contact the debris 106 and so that the airflow 120 generated by the vacuum assembly 119 can more easily carry the debris 106 toward the interior of the robot 102. In some implementations, vanes (e.g., the vane 114 shown in FIG. 1C) of the roller 104 contact the dustpan 125 as the roller 104 rotates and thus sweeps debris along the dustpan 125 toward the air conduit 128.

Example Cleaning Rollers

Figure 3A:
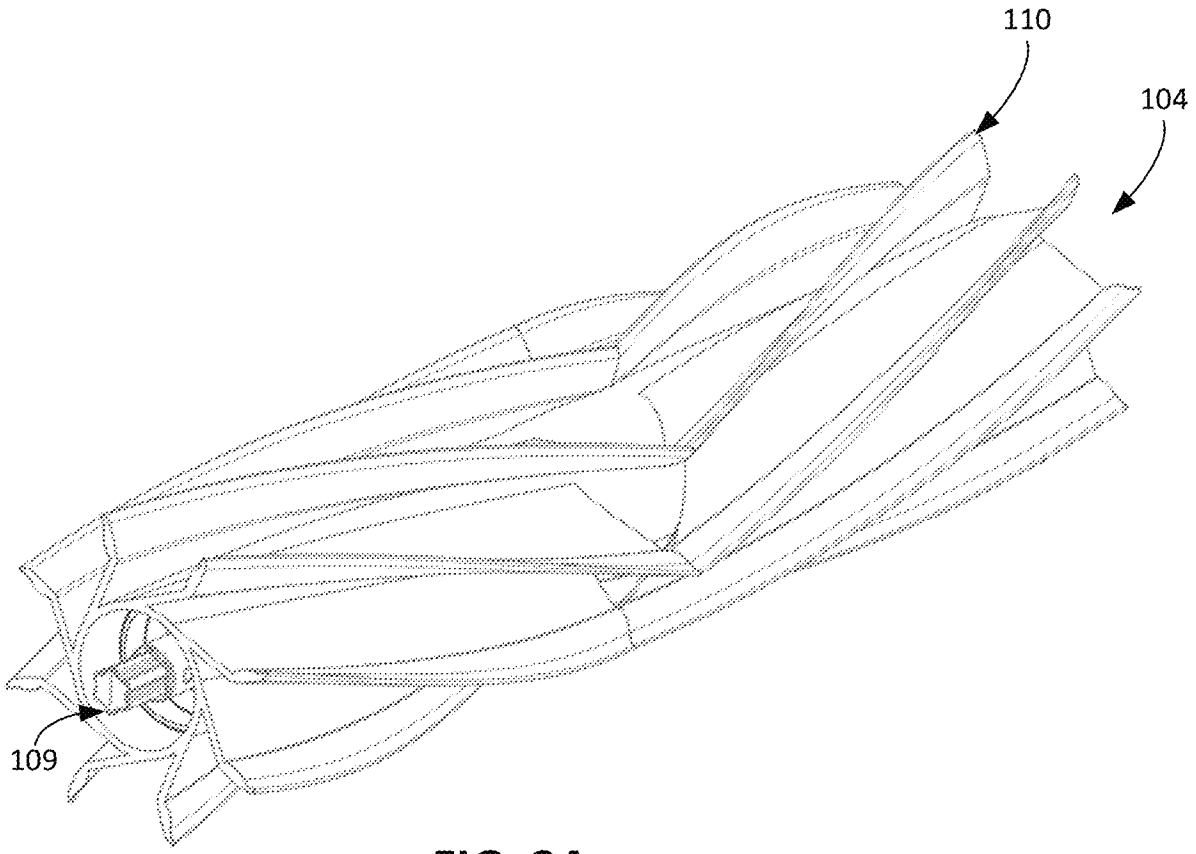
FIGS. 3A-3B are front perspective and front cross-sectional views, respectively, of a cleaning roller.
Figure 3B:
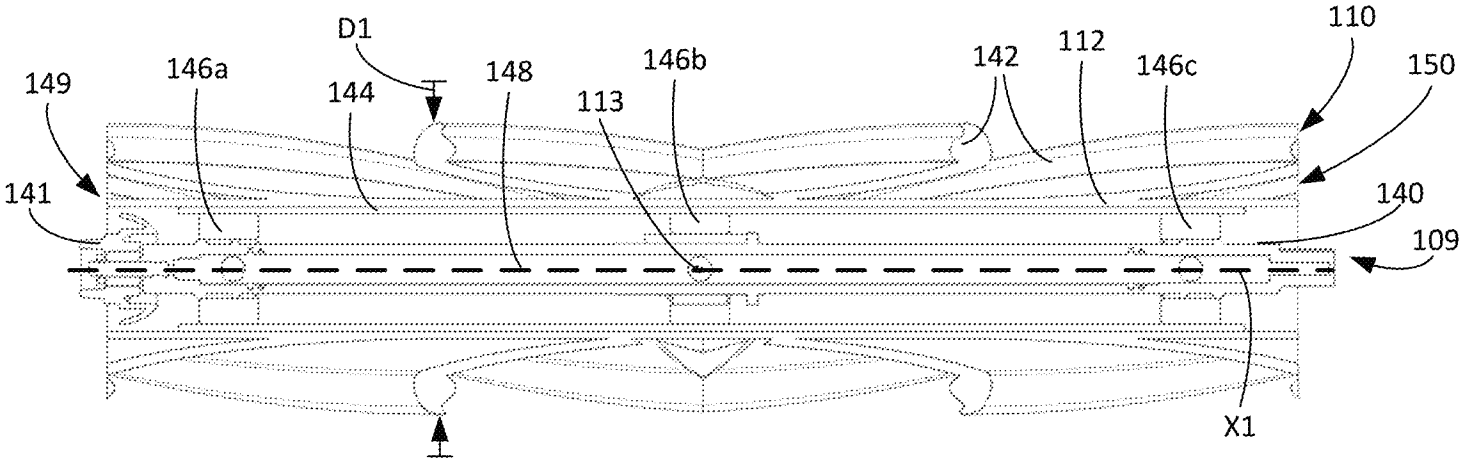

Various implementations of cleaning rollers, e.g., the roller 104, are described herein. FIGS. 3A and 3B show an example of the roller 104 including the outer sheath 110 and the support structure 109.

Referring to FIG. 3B, as described herein, the support structure 109 includes the core 140 and the end cap 141 mounted to the core 140. The support structure 109 is an interior stiff structure that provides radial support for the sheath 110, which is less stiff and more flexible than the support structure 109. In some implementations, the support structure 109 is attached to the sheath 110 in a manner such that the sheath 110 and the support structure 109 are tangentially coupled to one another, e.g., coupled to another along an interface extending along a path perpendicular to radial axes of the roller 104.

The core 140 includes a sleeve 144, support members 146*a*, 146*b*, 146*c* (collectively referred to as support members 146), and a shaft portion 148. The support structure 109 further includes the end cap 141. The end cap 141 is engaged to the shaft portion 148 and is mountable to the body 200 of the robot 102. The support structure 109 is rotationally coupled to the sheath 110 so that rotation of the support structure 109 results in rotation of the sheath 110.

The support members 146 are positioned along the shaft portion 148 and are spaced apart from one another. The support members 146 can include ring-shaped portions that engage the shaft portion 148, e.g., around a perimeter of a transverse section of the shaft portion 148. The support members 146 can be attached to the shaft portion 148, for example, with adhesive, mechanical interlocking, or another appropriate attachment mechanism. The support member 146*a* is positioned proximate a first end portion 149 of the roller 104, the support member 146*b* is positioned at or proximate the center 113 of the roller 104, and the support member 146*c* is positioned proximate a second end portion 150 of the roller 104. The support member 146*a* can be positioned a distance between 5% and 15% of the length L1 from the first end portion 149 of the roller 104, and the support member 146*c* can be positioned a distance between 5% to 15% of the length L1 from the second end portion 150 of the roller 104.

The sleeve 144 is positioned around the support member 146 and at least partially around the shaft portion 148. The sleeve 144 is, for example, cylindrical. An inner surface of the sleeve 144 is engaged to the support members 146, and an outer surface of the sleeve 144 is engaged to the shell 112 of the sheath 110. The sleeve 144, with the support members 146, can radially support the sheath 110. In particular, the support members 146 can be rigid members that inhibit radial deflection of the sheath 110 toward the longitudinal axis X1. The sheath 110 can be more easily deflected toward the longitudinal axis X1 in regions of the support structure 109 between the support members 146.

Figure 4A:
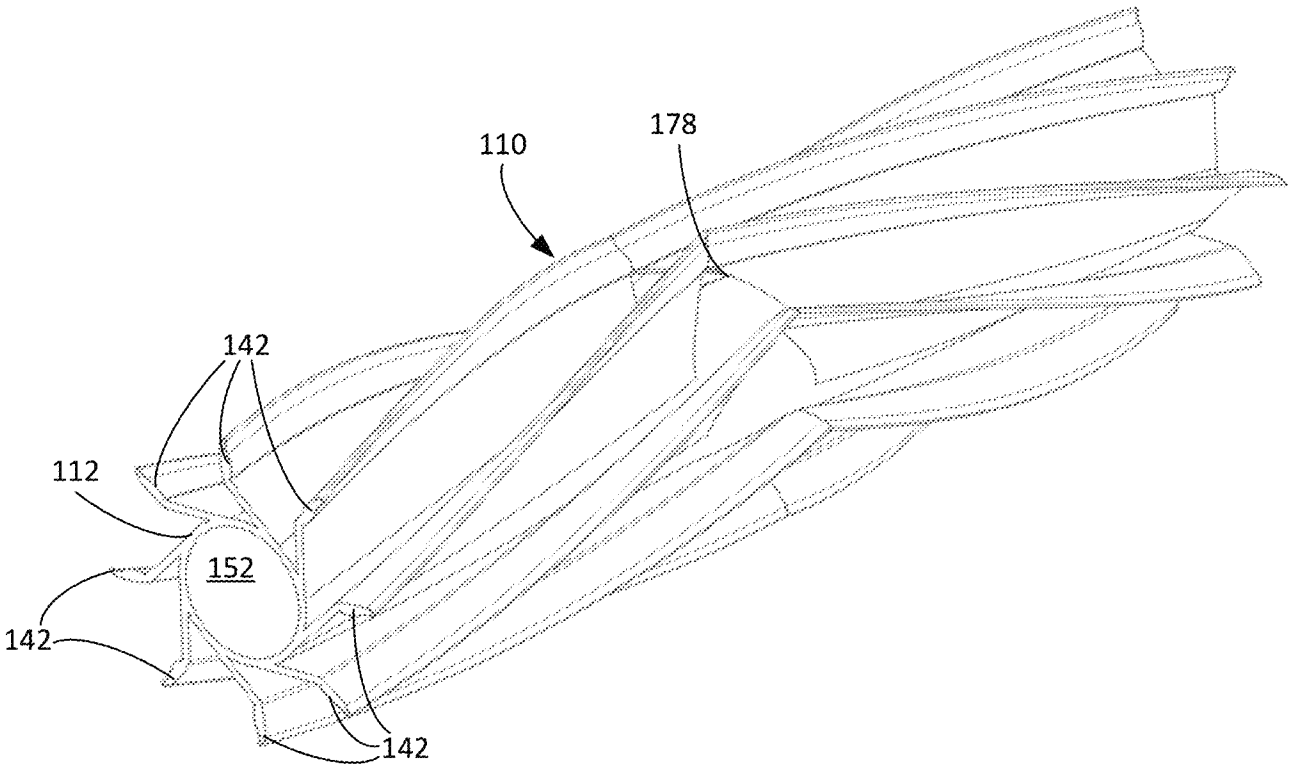
FIGS. 4A, 4B, 4C, 4D, and 4F are perspective, side, side, side, and front views, respectively, of an example of a sheath of the cleaning roller of FIG. 3A including a vane.

The sheath 110 is positioned around at least a portion of the support structure 109. The sheath 110 and, in particular, the shell 112 are positioned around the sleeve 144, the support members 146, and at least a portion of the shaft portion 148. An outer diameter D1 of the roller 104 is defined by the sheath 110, in particular, by the vanes 142 of the sheath 110. The outer diameter D1 is uniform across the length L1 (shown in FIG. 1B). 33. In some implementations, the diameter D1 of the roller 104 is between 30 and 90 millimeters, e.g., between 30 and 60 millimeters, 40 and 70 millimeters, 50 and 80 millimeters, or 60 and 90 millimeters. In some implementations, the outer diameter D1 of the roller D1 corresponds to an outer diameter of the roller 104 while the roller 104 is not rotating. The outer diameter of the roller 104 may increase as the roller 104 rotates due to centrifugal force FIGS. 4A-4E illustrate an example of the sheath 110. As shown in FIG. 4A, the sheath 110 includes the shell 112 and the vanes 142 (including the vane 114). In some implementations, the shell 112 is a cylindrical member including an inner surface 152 positioned around and in contact with the support structure 109 (shown in FIG. 3B). The shell 112 is cylindrical across a length of the sheath 110. The shell 112 can have a wall thickness between 0.5 mm and 3 mm, e.g., 0.5 mm to 1.5 mm, 1 mm to 2 mm, 1.5 mm to 2.5 mm, or 2 mm to 3 mm. In some implementations, the sheath 110 of the roller 104 is a monolithic component including the shell 112 and the vanes 142. Each of the vanes 142 has one end fixed to the outer surface of the shell 112 and another end that is free. A height of each of the vanes 142 is defined as the distance from the fixed end at the shell 112, e.g., the point of attachment to the shell 112, to the free end. Referring briefly to FIG. 4D, for example, a height H1 of the vane 114 is between 0.5 and 2.5 centimeters, e.g., between 1 and 2 centimeters, 1.25 and 1.75 centimeters, or 1.4 and 1.6 centimeters. In some implementations, the height H1 of the vane 114 is 30% to 70% of the diameter of the sheath 110 a radial distance between the tip portion 154 of the vane 114 and the longitudinal axis X1. The free end sweeps an outer circumference of the sheath 110 during rotation of the roller 104. The outer circumference is consistent along the length of the roller 104.

Figure 4B:
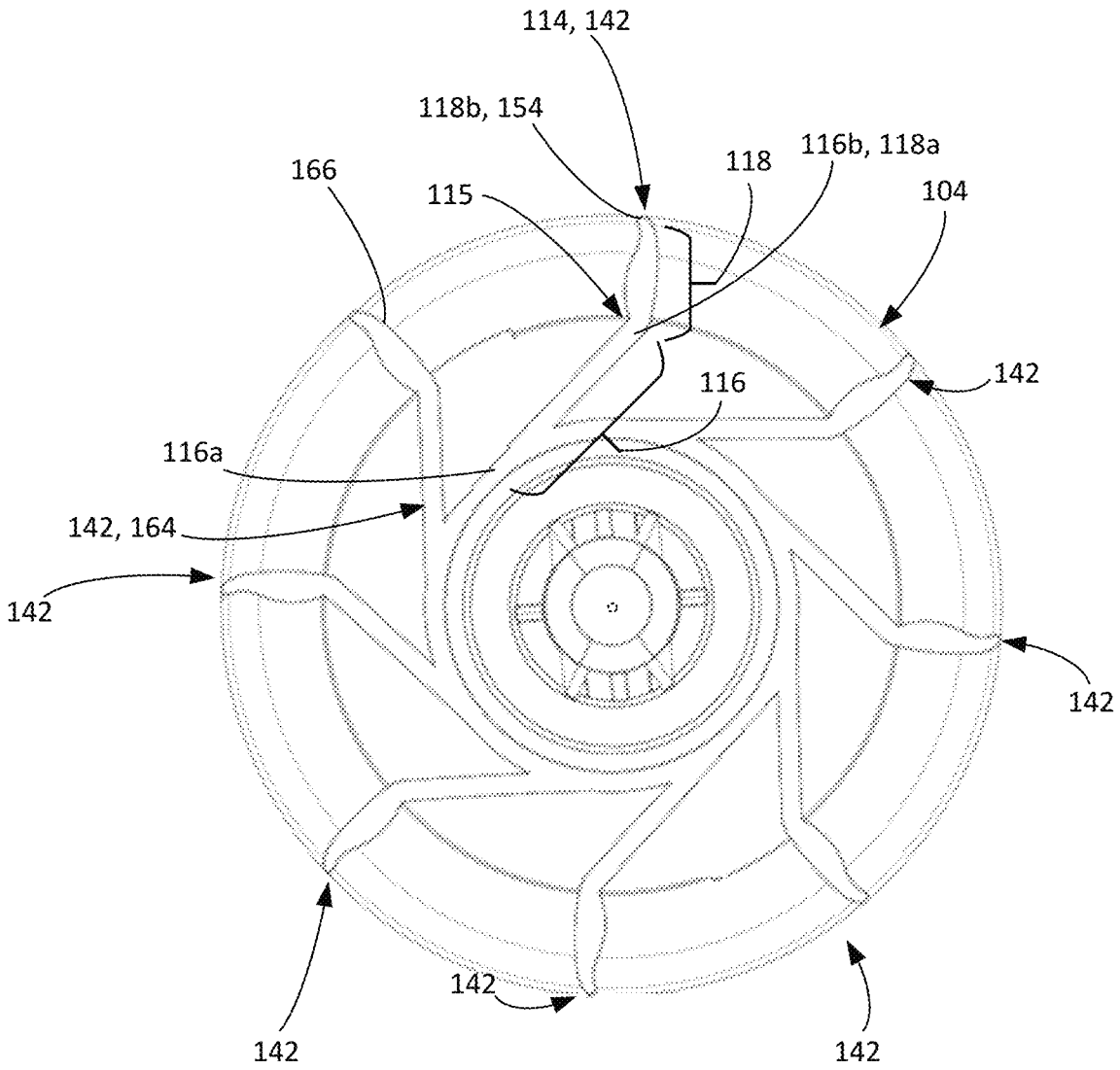
Figure 4C:
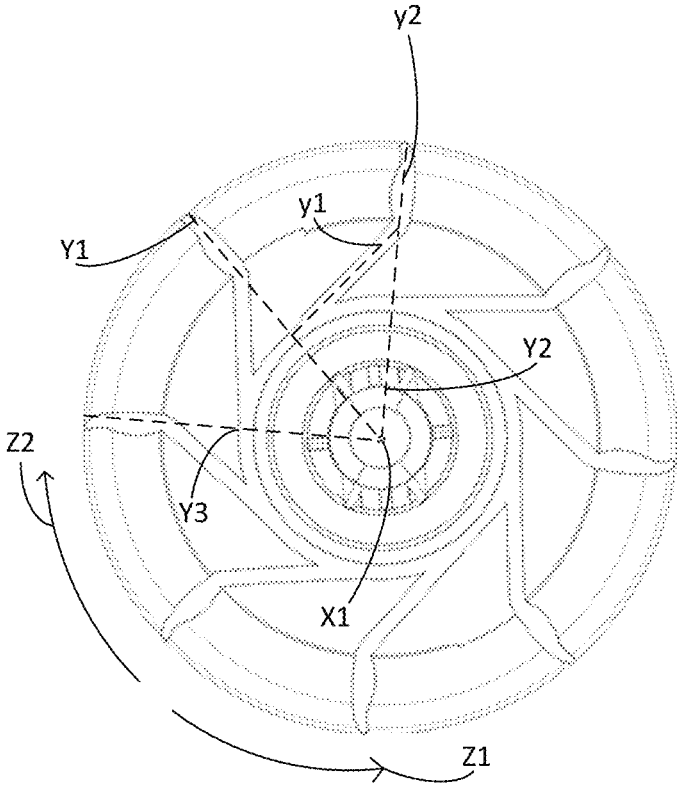
Figure 4D:
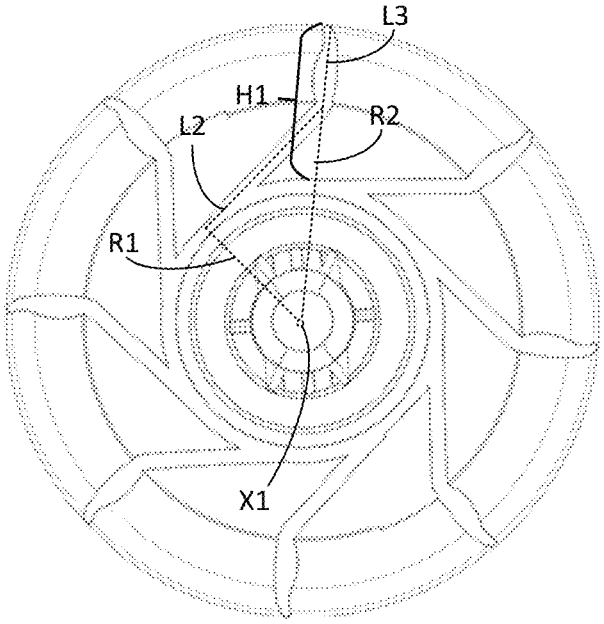

Referring to FIGS. 4B-4D, the vane 114 is a deflectable portion of the sheath 110 that, in some cases, engages with the floor surface 10 when the roller 104 is rotated during a cleaning operation. Referring to FIG. 4B, the vane 114 deflects when it contacts the floor surface 10 as the roller 104 rotates. The vane 114 is angled rearwardly relative to a direction of rotation of the roller 104 such that the vane 114 more readily deflects in response to contact with the floor surface 10.

The vane 114 includes the first portion 116, the second portion 118, and the bend 115 where the first portion 116 and the second portion 118 are attached to one another. The first portion 116 is attached to the shell 112 and the second portion 118 is attached to the first portion 116 at the bend 115. In particular, a first end 116*a* of the first portion 116 is attached to the shell 112 and a second end 116*b* of the first portion 116 is attached to a first end 118*a* of the second portion 118. Referring also to FIG. 4C, the first portion 116 of the vane 114 is attached to the shell 112 at a location intersecting a radial axis Y1 of the roller 104. The first portion 116 of the vane 114 extends along an axis y1 angled relative to the radial axis Y1 and away from the radial axis Y1 in a tangential direction Z2 and away from a tangential direction Z1. The second portion 118 of the vane 114 extends along an axis y2 angled relative to the axis y1 along which the first portion 116 of the vane 114 extends. An angle, e.g., a minimum angle, between the axis y1 and the radial axis Y1 is greater than an angle, e.g., a minimum angle, between the axis y2 and the radial axis Y1. The second portion 118 of the vane 114 terminates at a tip portion 154 of the vane 114. The tip portion 154 is positioned along the axis y2 and the radial axis Y2.

In implementations in which the shell 112 is cylindrical, the first portion 116 of the vane 114 can extend tangentially from an outer circumference of the shell 112. In some implementations, an angle between the axis y1 along which the first portion 116 of the vane 114 extends and the radial axis Y1 is between 70 and 110 degrees, e.g., between 80 and 100 degrees, 85 and 95 degrees, or 88 and 92 degrees, or about 85, 90, or 95 degrees. The angle between the axis y1 along which the first portion 116 of the vane 114 extends and the axis y2 along which the second portion 118 of the vane 114 extends is between 90 and 170 degrees, e.g., between 90 and 150 degrees, 90 and 130 degrees, or 90 and 110 degrees, or about 95, 105, or 115 degrees. An angle between the radial axis Y1 and the radial axis Y2 can be between 20 and 70 degrees, e.g., between 25 and 65 degrees, 30 and 60 degrees, 35 and 55 degrees, or 40 and 50 degrees.

As described herein, the second portion 118 of the vane 114 extends along the axis y2. In some implementations, the second portion 118 of the vane 114 extends through a radial axis Y2 of the roller 104. An angle between the radial axis Y2 and the axis y2 can be between 0 and 15 degrees, e.g., no more than 10 degrees, 5 degrees, 3 degrees, or 1 degree. In some implementations, the axis y2 extends along the radial axis Y2 and is coincident with the radial axis Y2.

Figure 4E:
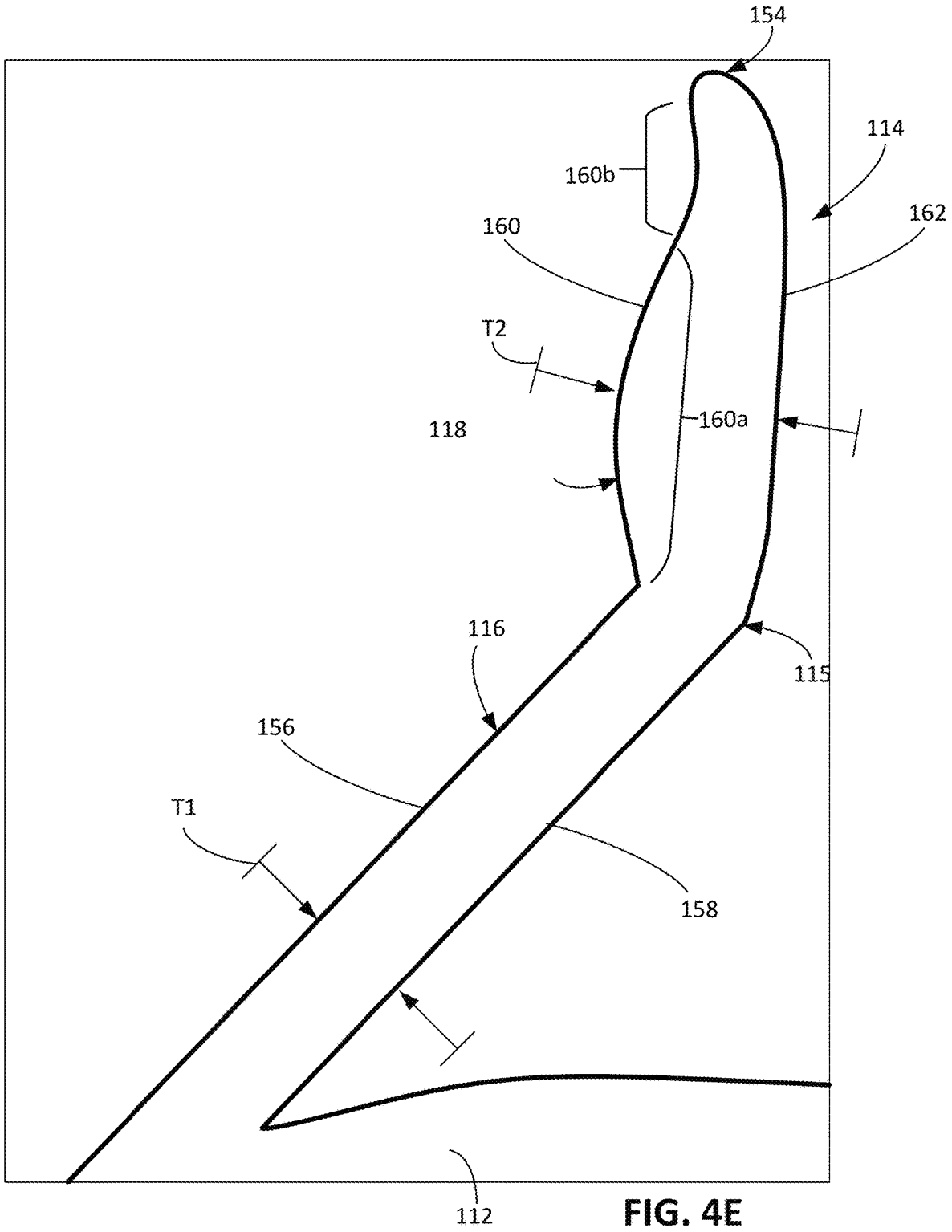
FIG. 4E is an enlarged side view of the vane of the sheath of the cleaning roller of FIG. 4A.

Referring to FIG. 4E showing an enlarged view of the vane 114, the first portion 116 of the vane 114 includes a first surface 156 and a second surface 158. The first surface 156 faces the tangential direction Z1 and away from the tangential direction Z2, and the second surface 158 faces the tangential direction Z2 and away from the tangential direction Zl. A thickness T1 of the first portion 116 of the vane 114 is between 0.5 and 4 millimeters, e.g., between 0.5 and 1 millimeters, between 1 and 3 millimeters, 1.5 and 3.5 millimeters, or between 2 and 4 millimeters. The first surface 156 and the second surface 158 are substantially parallel to one another. The first portion 116 extends outwardly from the shell 112 and terminates at the bend 115. A maximum thickness T2 of the second portion 118 of the vane 114 is between 2 and 5 millimeters, e.g., between 2 and 4 millimeters, 2 and 3 millimeters, or 2 and 2.5 millimeters. The maximum thickness T2 of the second portion 118 of the vane 114 is 10 to 75% greater than the thickness T1 of the first portion 116 of the vane 114, e.g., 10% to 50%, 10% to 40%, or 20% to 35% greater than the thickness T1 of the first portion 116 of the vane 114.

Dimensions of the first portion 116 and the second portion 118 of the vane 114 can vary between implementations. Referring also to FIG. 4D, a radial distance R1 between the first end 116*a* of the first portion 116 and the longitudinal axis X1 is between 1 and 3 centimeters, e.g., between 1 and 2 centimeters, 1.5 and 2.5 centimeters, or 2 and 3 centimeters. A radial distance R2 between the second end 116*b* of the first portion 116 and the longitudinal axis X1 is between 1.5 and 3.5 centimeters, e.g., between 1.5 and 2.5 centimeters, 2 and 3 centimeters, or 2.5 and 3.5 centimeters. The radial distance R1 is 50% to 90% of the radial distance R2, e.g., between 50% and 80%, 50% and 75%, or 50% and 70% of the radial distance R2. A length L2 of the first portion 116, i.e., the length between the first end 116*a* of the first portion 116 and the second end 116*b* of the first portion 116, is between 0.5 and 3 centimeters, e.g., between 0.5 and 2.5 centimeters, 0.5 and 2 centimeters, or 1 and 2 centimeters. A length L3 of the second portion 118, i.e., the length between the first end 118*a* and a second end 118*b* of the second portion 118, is between 0.2 and 1.5 centimeters, e.g., between 0.2 and 1.2 centimeters, 0.2 and 1 centimeter, or 0.4 and 1 centimeter. The length L3 of the second portion 118 is 25% to 75% of the length L2 of the first portion 116, e.g., between 30% and 70%, 35% and 65%, or 40% and 50% of the length L2 of the first portion 116. An overall length of the vane 114 is between 1.5 and 4 centimeters, e.g., between 1.5 and 3.5 centimeters, 1.5 and 3 centimeters, or 1.75 and 2.75 centimeters.

Referring to FIG. 4E, the second portion 118 of the vane 114 includes a first surface 160 and a second surface 162. The first and second surfaces 160, 162 of the second portion 118 are positioned between the tip portion 154 of the vane 114 and the first portion 116 of the vane 114. The first surface 160 faces the tangential direction Z1 and away from the tangential direction Z2, and the second surface 162 faces the tangential direction Z2 and away from the tangential direction Z1. The first surface 160 of the second portion 118 is connected to the first surface 156 of the first portion 116, and the second surface 162 of the second portion 118 is connected to the second surface 162 of the first portion 116.

In some implementations, the first surface 160 is convex or includes a convex portion. In some implementations, the first surface 160 is straight or includes a straight portion. In some implementations, the first surface 160 is concave or includes a concave portion. In some implementations, the first surface 160 includes at least one of a straight portion, a concave portion, or a convex portion. In some implementations, the second surface 162 is straight or includes a straight portion. In some implementations, the second surface 162 is convex or includes a convex portion. In some implementations, the second surface 162 is concave or includes a concave portion. In some implementations, the second surface 162 includes at least one of a straight portion, a concave portion, or a convex portion. In the example depicted in FIG. 4E, the first surface 160 includes a convex portion 160*a* attached to the first portion 116 of the vane, and a concave portion 160*b* attached to the convex portion 160*a*. In some implementations, the tip portion 154 is scoop-shaped to allow the vane 114 to easily carry debris into the robot 102. For example, the tip portion 154 includes at least a portion of the concave portion 160*b* of the first surface 160.

As described herein, in some implementations, the sheath 110 can include multiple vanes 142, each of the vanes 142 including features similar to the features described in connection with the vane 114. Each of the vanes 142 can be symmetric about a central transverse plane 172 (shown in FIG. 4F) perpendicular to the longitudinal axis X1 of the roller 104 and located at the center 113 of the roller 104. As shown in FIGS. 4B-4D, the vanes 142 include the vane 114 and a vane 164. The vane 164 can be geometrically similar to the vane 114 except that the vane 164 is positioned at a different location along the shell 112. The vane 164 extends outwardly from the shell 112 at a location offset in the tangential direction Z1 from the location where the vane 114 extends outwardly from the shell 112. For example, the location at which the vane 164 extends outwardly from the shell 112 can be coincident with a radial axis Y3 of the roller 104. An angle between the radial axis Y3 and the radial axis Y1 can be between 30 and 90 degrees, e.g., between 30 and 45 degrees, 45 and 60 degrees, 60 and 75 degrees, or 75 and 90 degrees. The angle between the radial axis Y3 and the radial axis Y1 can be equal to an angle between the radial axis Y1 and the radial axis Y2. In some implementations, a second portion 166 of the vane 164 extends along the radial axis Y1, which as described herein extends through the location at which the vane 114 meets with the shell 112. The second portion 166 can include geometric features similar to those described with respect to the second portion 118 of the vane 114.

As shown in FIG. 4B, the sheath 110 can include eight vanes 142. In other implementations, the sheath 110 can include fewer or more vanes, e.g., 2, 3, 4, 5, 6, 7, 9, or more vanes. In some implementations, the sheath 110 includes 4 to 12 vanes, e.g., 4 to 8 vanes, 6 to 10 vanes, or 8 to 12 vanes. As described herein, a configuration of the vane 114 can improve the debris pickup capability of the roller 104. While certain features are described in connection with the vane 114, in certain implementations, the vanes 142 can include some or all of these features.

Figure 4F:
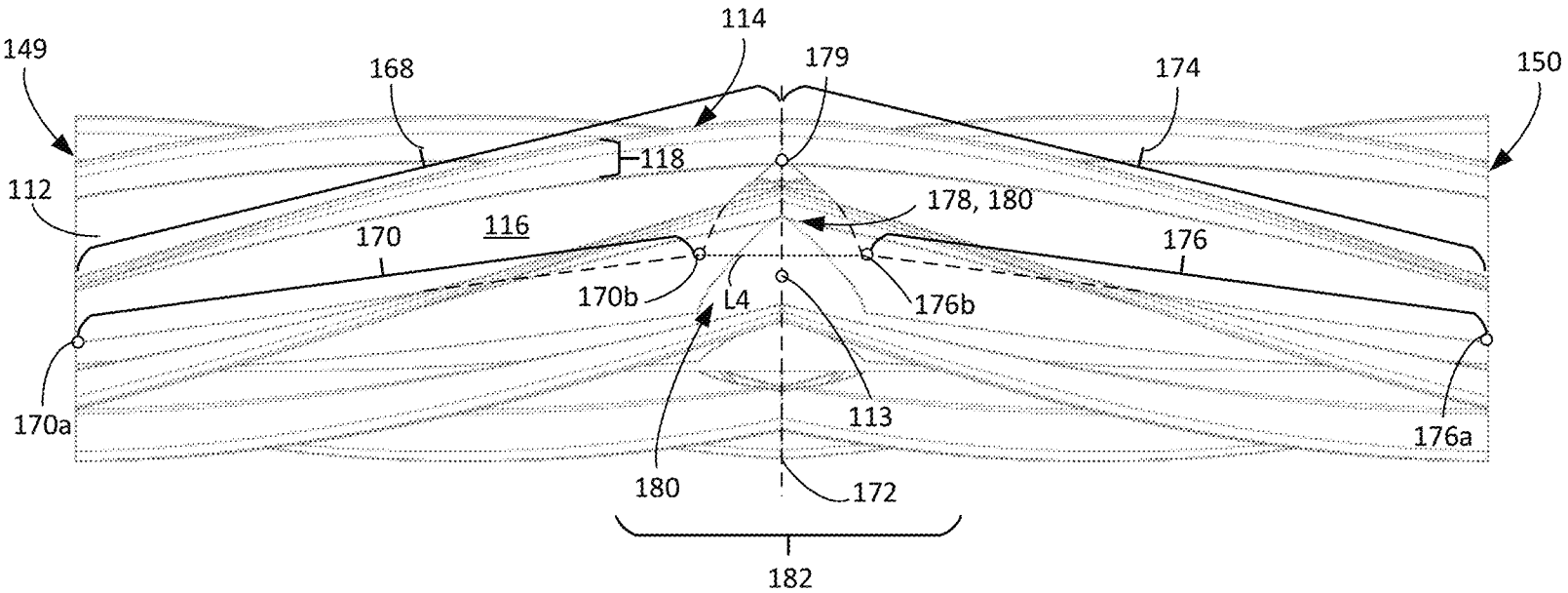

Referring to FIG. 4F, a segment 168 of the vane 114 extends along the shell 112 along a helical path 170. Helical paths for portions of the vane 114 can cause debris swept up by the roller 104 to move toward the center 113 of the roller 104, where a force of the airflow drawn by the vacuum assembly 119 (shown in FIG. 2A) may be strongest along a length of the roller 104.

The helical paths can also decrease an amount of noise produced by the roller 104 as the vane 114 contacts the floor surface 10.

The helical path 170 extends longitudinally and circumferentially along the shell 112, e.g., along the longitudinal axis X1 and along the tangential direction Z2. The helical path 170 extends from a first end 170*a* of the helical path 170 to a second end 170*b* of the helical path 170 along the shell 112 in the tangential direction Z2 (shown in FIG. 4C) of the roller 104. The first end 170*a* of the helical path 170 is positioned proximate the first end portion 149 of the roller 104, and the second end 170*b* of the helical path 170 positioned proximate the central transverse plane 172. The segment 168 extends from the first end portion 149 of the roller 104 to the central transverse plane 172 extending through the center 113 of the roller 104 and perpendicular to the longitudinal axis X1 (shown in FIG. 1B).

The vane 114 may form a herringbone pattern along the shell 112. For example, a segment 174 of the vane 114 extends along the shell 112 along a helical path 176, and the segment 174 with the segment 168 of the vane 114 can form the herringbone pattern. The helical path 176 thus extends longitudinally and circumferentially along the shell 112. The helical path 176 extends from a first end 176*a* of the helical path 176 to a second end 176*b* of the helical path 176 along the shell 112 in the tangential direction Z2 (shown in FIG. 4C) of the roller 104. The first end 176*a* of the helical path 176 is positioned proximate the second end portion 150 of the roller 104, and the second end 176*b* of the helical path 176 positioned proximate the central transverse plane 172. The segment 174 extends from the second end portion 150 of the roller 104 to the central transverse plane 172. The segment 168 of the vane 114 is connected to the segment 174 of the vane 114 at the central transverse plane 172. The segment 168 and the segment 174, in some implementations, are symmetric to one another about the central transverse plane 172. A pitch of the helical path 170 and a pitch of the helical path 176 can be between 300 and 900 millimeters, e.g., between 300 and 600 millimeters, 400 and 700 millimeters, 500 and 800 millimeters, or 600 and 900 and millimeters.

In some implementations, the roller 104 includes an opening 178 positioned at or proximate to the center 113 of the roller 104. The opening 178 can mitigate noise produced by the roller 104 as the roller 104 contact a floor surface by reducing a stiffness of the vane 114 toward at a portion near the center 113 of the roller 104. In some implementations, the opening 178 is symmetric about the central transverse plane 172 of the roller 104.

The opening 178 (also shown in FIG. 4A) extends along at least part of a central portion 182 of the roller 104, e.g., a lengthwise portion of the roller 104 symmetric about the central transverse plane 172 and having a length between 25% and 50% of the length L1 of the roller 104. The opening 178 can extend away from the shell 112 outwardly toward an outer circumference of the roller 104, and can extend through the vane 114. For example, the opening 178 can extend only partially through the vane 114 toward the tip portion 154 (shown in FIG. 4B) of the vane 114. In some implementations, the opening 178 extends outwardly from the shell 112 toward the tip portion 154 of the vane 114. The opening 178 can taper toward the tip portion 154 of the vane 114. For example, a length of the opening 178 along the longitudinal axis X1 can decrease from proximate the shell 112 to proximate the tip portion 154 of the vane 114. A maximum length L4 of the opening 178 along the longitudinal axis X1 can be between 15 and 45 millimeters, e.g., between 15 and 30 millimeters, 20 and 35 millimeters, 25 and 40 millimeters, or 30 and 45 millimeters.

As shown in FIG. 4F, in some implementations, the opening 178 extends through an entirety of the first portion 116 of the vane 114, e.g., an entire length of the first portion 116 of the vane 114, and through none of or only some of the second portion 118 of the vane 114. For example, the opening 178 terminates at a distal termination point 179 coinciding with the first end 118*a* (shown in FIG. 4B) of the second portion 118 of the vane 114. This distal termination point 179 coincides with a location where the first portion 116 of the vane 114 is attached to the second portion 118 of the vane 114. The first portion 116 of the vane 114 along the segment 168 of the vane 114 can be separated from the first portion 116 of the vane 114 along the segment 174 of the vane 114. In particular, the segment of the first portion 116 of the vane 114 along the segment 168 of the vane 114 is separated from the segment of the first portion 116 of the vane 114 along the segment 174 of the vane 114 by the opening 178. The second portion 118 of the vane 114 can extend continuously along the vane 114 from the first end portion 149 of the roller 104 to the second end portion 150 of the roller 104, e.g., along at least 90% to 95% of the length L1 (shown in FIG. 1B) of the roller 104. While described as extending through an entirety of the first portion 116 of the vane 114, in some implementations, the opening 178 can extend only partially through the first portion 116 of the vane 114 and through none of the second portion 118 of the vane 114.

The opening 178 can be one of multiple openings 180, each of the openings 180 extending through a corresponding one of the vanes 142. Each of the openings 180 can have features similar to those described with respect to the opening 178. In some implementations, each of the openings 180 can extend only through a portion of the first portion 116 of the vane 114, e.g., only along a base of the first portion 116 where the first portion 116 is attached to the elongate member 107. The openings 180 can reduce overall power consumption for driving the roller 104 by reducing an overall stiffness of the vane 114.

Alternative Implementations

A number of implementations have been described. Nevertheless, it will be understood that various modifications may be made. Certain implementations described herein are described with respect to the roller 104 or other rollers described herein. Features described with respect to these implementations are not limited to these implementations and are applicable to other implementations.

While the robot 102 is described as having a rectangular shaped front portion 202*a* and a semicircular shaped rear portion 202*b*, in some implementations, an outer perimeter of the robot 102 defines another appropriate shape. For example, in some cases, the body 200 of the robot 102 has a substantially circular shape. Alternatively, the body 200 of the robot 102 has a substantially rectangular shape, a substantially square shape, a substantially ellipsoidal shape, or a substantially Reuleaux polygonal shape.

While certain rollers described herein are described as including a support structure including a core, and the core includes support members and a shaft portion, the support structure can vary in other implementations. For example, the roller 104 is described as including the support structure 109, which in turn includes the core 140 and the end cap 141. The core 140 is described as including the sleeve 144, the support members 146*a*, 146*b*, 146*c*, and the shaft portion 148. In certain implementations, the support structure 109 can be a monolithic component that supports the sheath 110. In certain implementations, the support structure 109 includes a portion of the elongate member 107 or corresponds to the elongate member 107. For example, the vane 114 can be attached directly to the support structure 109 in some implementations. In some implementations, the vane 114 is integral to the support structure 109.

While the sheath 110 is described as having a cylindrically shaped shell 112, in some implementations, the shell 112 includes a frustoconically shaped portion. For example, the shell 112 can include two halves divided by the central transverse plane 172 of the roller 104. The two halves can each be frustoconically shaped. The vanes 142 of the roller 104 can extend outwardly from the shell 112 such that an outer diameter of the sheath 110 is uniform along a length of the sheath 110.

The support structure 109 is described as being within the sheath 110. In some implementations, the support structure 109 include components that are separate from components of the sheath 110. In some implementations, the support structure 109 and the sheath 110 are integral with one another. For example, the roller 104 can be a monolithic structure. The roller 104 can be a solid structure including the vanes 142. In some examples in which the roller 104 is a solid structure, rather than including the shell 112 and the support structure 109, the roller 104 could include a rod member extending along the longitudinal axis X1 of the roller 104. The vane 114 could extend along the rod member. The rod member could be solid.

While certain rollers are described herein as having multiple vanes, in some implementations, a roller includes a single vane. For example, while the roller 104 is described as having multiple vanes 142, in some implementations, the roller 104 includes a single vane, e.g., the vane 114.

Certain rollers are described herein as having vanes with portions extending along helical paths that extend along an elongate member. These portions of the vanes that extend along these helical paths and trajectories of these helical paths may vary in certain implementations. For example, while the segment 168 and the segment 174 are described as being part of the vane 114 extending across an entire length of the sheath 110, in some implementations, the sheath 110 includes a first vane extending along an entire length of a first half of the sheath 110 and a second vane extending along an entire length of a second half of the sheath 110. The first and second vanes have geometric features similar to geometric features of the segments 168, 174, respectively, of the vane 114 as described herein, except that the first and second vanes are separated from one another and are circumferentially offset from one another, e.g., offset from one another in a tangential direction. For example, the first vane can extend along a first helical path having a pitch similar to the pitch described herein with respect to the helical path 170, and the second vane can extend along a second helical path having a pitch similar to the pitch described herein with respect to the helical path 176. A first longitudinal end of the first helical path for the first vane can be circumferentially offset relative to a first longitudinal end of the second helical path for the second vane, e.g., offset in a tangential direction. A second longitudinal end of the first helical path for the first vane can be circumferentially offset relative to a second longitudinal end of the second helical path for the second vane, e.g., offset in a tangential direction.

The first vane can extend from the first end portion 149 of the roller 104 to at least the central transverse plane 172 of the roller 104 and in some implementations, can extend beyond the central transverse plane 172 into the second half of the sheath 110. Similarly, the second vane can extend from the second end portion 150 of the roller 104 to at least the central transverse plane 172 of the roller 104 and in some implementations, can extend beyond the central transverse plane 172 into the first half of the sheath 110. The first vane and the second vane can thus circumferentially overlap with one another along at least part of the central portion 182 of the roller 104.

The first vane can be part of a first set of vanes along the first half of the roller 104, and the second vane can be a part of a second set of vanes along the second half of the roller 104, with the first set of vanes being circumferentially offset from the second set of vanes along the second half of the roller 104 such that the first set of vanes are separated from the second set of vanes. Each vane of the first set of vanes is positioned between a corresponding pair of vanes of the second set of vanes, and each vane of the second set of vanes is positioned between a corresponding pair of vanes of the first set of vanes.

Figure 7:
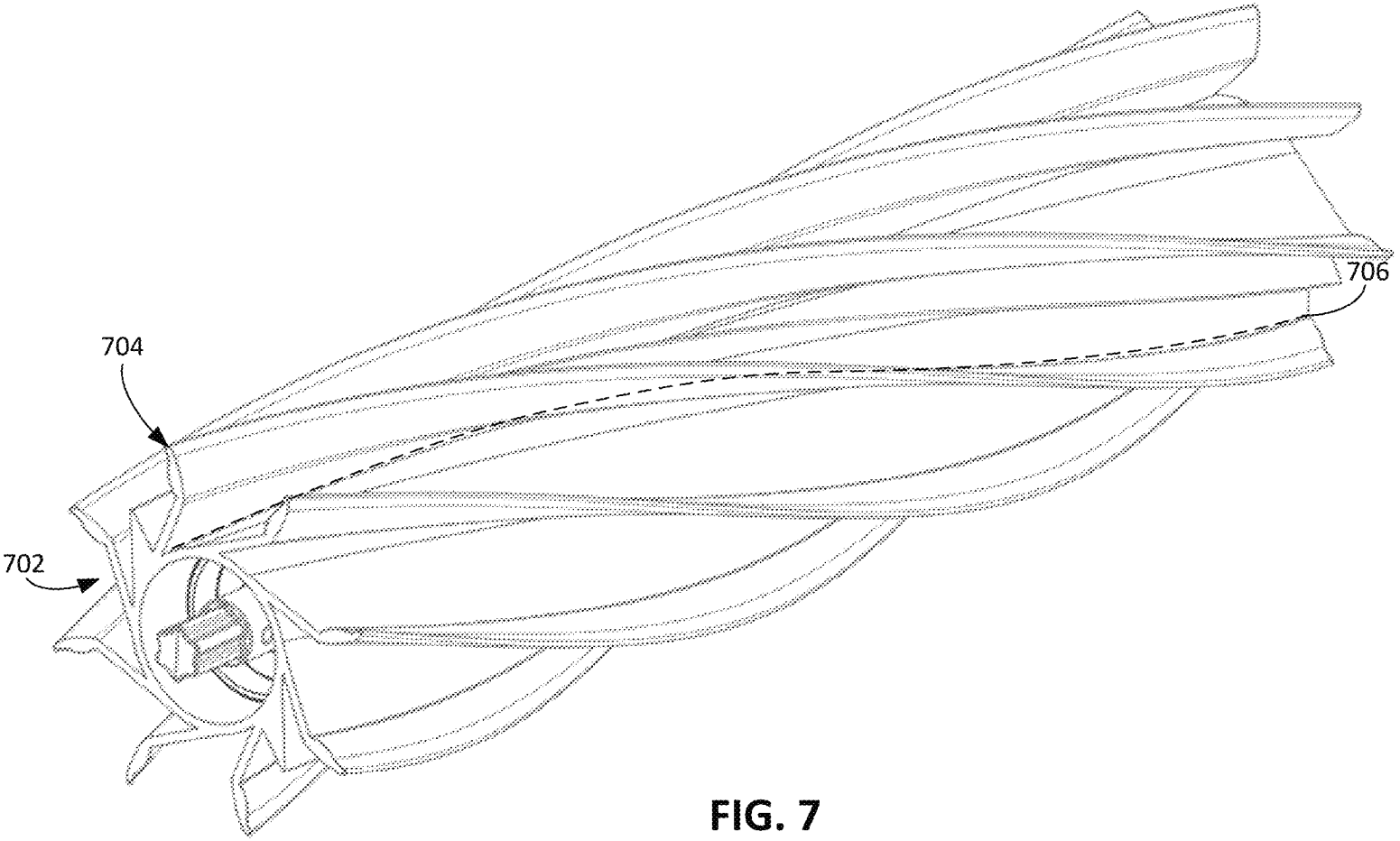
FIG. 7 is a perspective view of a further example of a sheath of a cleaning roller.

While the vane 114 is described as having the segments 168, 174 extending along oppositely oriented helical paths, in some implementations, referring to FIG. 7, a vane 704 of a sheath 702 extends along a helical path 706 extending along an entire length of the sheath 702. A pitch of the helical path 706 can be between 300 and 900 millimeters, e.g., between 300 and 600 millimeters, 400 and 700 millimeters, 500 and 800 millimeters, or 600 and 900 and millimeters.

While the helical paths along which portions of the vane 114 extend are described as having a pitch, in some implementations, the pitch of the helical path may not be uniform across and entire length or the roller 104. In some implementations, the pitch of the helical path 170 or the helical path 176 may vary, e.g., increase or decrease from an outer end portion of the roller 104 toward the center 113 of the roller 104.

Certain rollers described herein include openings along vanes of the rollers. For example, the roller 104 is described in some implementations as having a single opening 178 proximate the center 113 of the roller 104. In some implementations, the roller 104 includes multiple openings positioned along a length of the vane 114. The multiple openings are spaced apart from one another and can be symmetrically distributed throughout the length of the vane 114. For example, the multiple openings are symmetric about the central transverse plane 172.

Figure 5A:
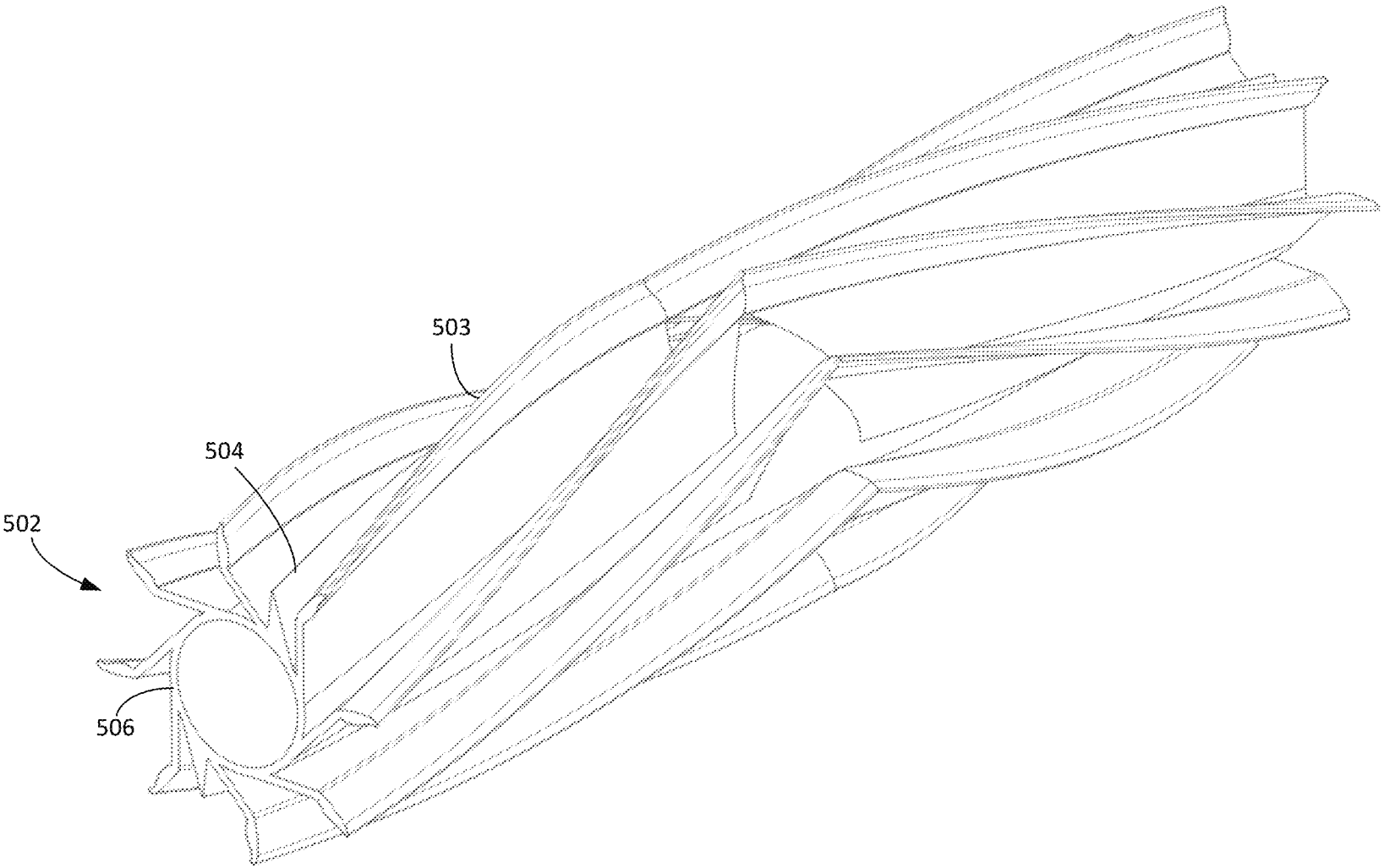
FIGS. 5A-5B are perspective and side views, respectively, of a further example of a sheath of a cleaning roller including a vane.

Certain rollers described herein can include features in addition to vanes that extend outwardly from elongate members of the rollers. In some implementations, a roller includes a nub for supporting the roller against an obstacle on a floor surface under the robot. For example, referring to FIG. 5A, a sheath 502 can be similar to the sheath 110 (shown in FIG. 4A) except that the sheath 502 includes a nub 504 extending outward from an elongate member, e.g., the shell 506 (similar to the shell 112) of the sheath 502, away from a longitudinal axis X2 of the roller (not shown). The nub 504 can be a rigid protrusion from the shell 506. In particular, a vane 503 (similar to the vane 114 described herein) can be relatively more deflectable than the nub 504. As the roller is moved over an obstacle on a floor surface, the vane 503 can deflect in response to contact with the obstacle. The nub 504 can deflect relatively less than the vane 503 in response to contact with the obstacle. The vane 503 can deflect an amount such that a height of the vane 503 relative to the shell 506, while the vane 503 is deflected, is less than a height of the nub 504 relative to the shell 506, while the nub 504 is deflected. The nub 504 can accordingly support the roller against the obstacle and thus allow the roller to move over the obstacle. In some implementations, the nub 504 extends along a helical path similar to the helical path along which the vane 503 extends (e.g., the helical path 170), except that the helical path along which the nub 504 extends is circumferentially offset from the helical path along which the vane 503 extends.

Figure 5B:
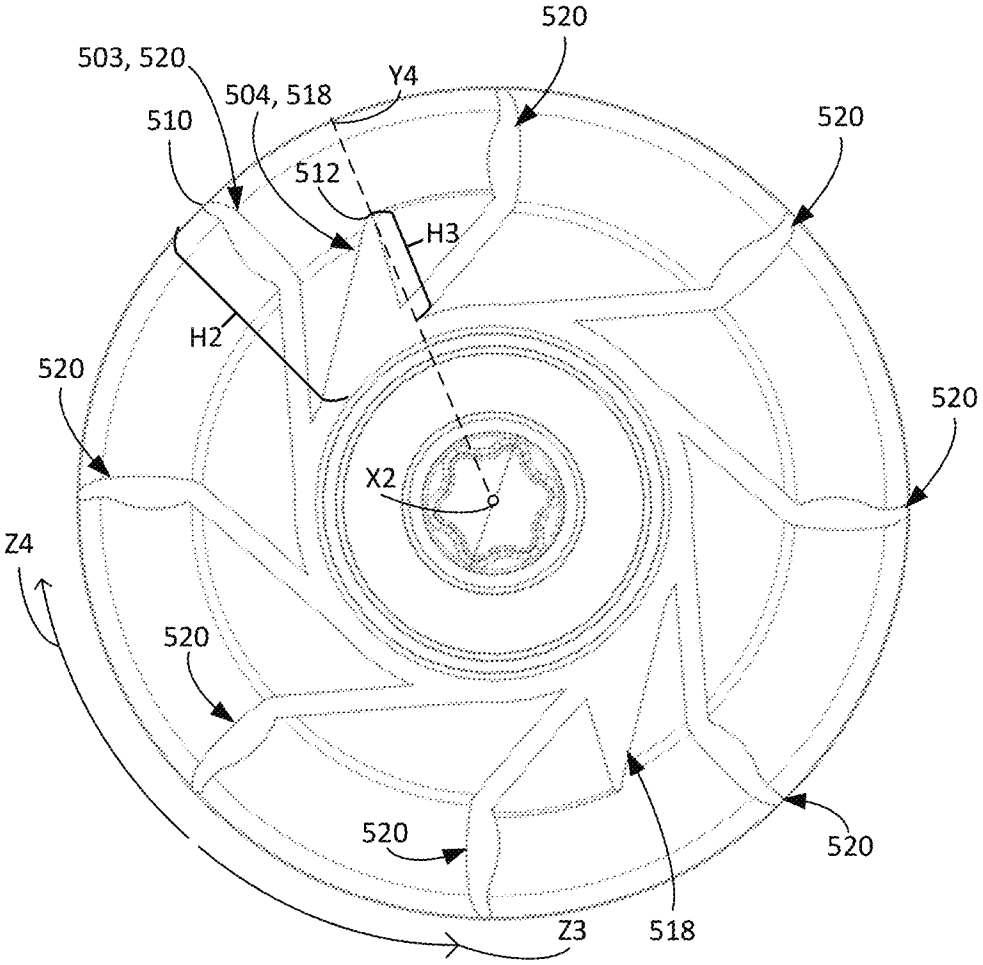

Referring to FIG. 5B, a height H2 (similar to a height H1 described with respect to the vane 114) of an outer tip portion 510 of the vane 503 (similar to the vane 114) relative to or above the shell 506 is greater than a height H3 of an outer tip portion 512 of the nub 504 relative to or above the shell 506. The height H3 relative to the height H2 can be selected such that the vane 503 contacts the nub 504 before the nub 504 interacts with an obstacle under the robot. For example, if the roller contacts an obstacle on the floor surface, the vane 503 can deflect in response to the contact. As the vane 503 deflects, the vane 503 moves toward the nub 504 until the vane 503 contacts the nub 504. The vane 503, supported against the nub 504, can contact the obstacle. The vane 503 and the nub 504 can thus together support the roller against the obstacle and thus allow the roller to move over the obstacle. The height H2 can be 25% to 150% greater than the height H3, e.g., between 25% and 50%, 50% and 75%, 75% and 100% greater than the height H3. The height H3 of the nub 504 can be between 0.25 and 2.0 centimeters, e.g., between 0.25 and 1.5 centimeters, 0.5 and 2 centimeters, between 0.5 and 1.5 centimeters, or between 0.6 and 1.2 centimeters.

The nub 504 can taper from the shell 506 to the tip portion 512 of the nub 504. The nub 504 can have a maximum thickness between 8 and 18 millimeters, e.g., between 8 and 14 millimeters, 10 and 16 millimeters, or 12 and 18 millimeters. The maximum thickness of the nub 504 can be at a base of the nub 504 where the nub 504 is attached to the shell 506. The nub 504 can be substantially triangular or have a triangular portion. For example, the nub 504 can include a surface 514 facing a tangential direction Z3, and a surface 516 facing a tangential direction Z4, the surface 514 and the surface 516 forming two sides of a substantially triangular protrusion from the shell 506.

Figure 5C:
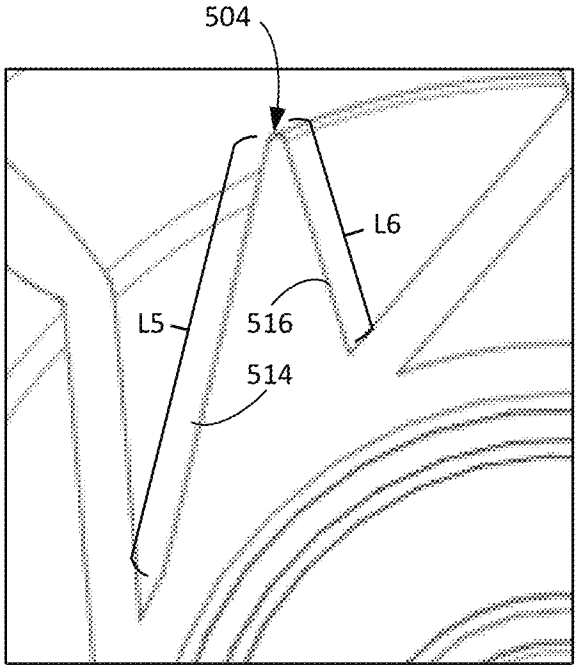
FIG. 5C is an enlarged side view of a nub of the sheath of the cleaning roller of FIG. 5A.

Referring to FIG. 5C, a length L5 of the surface 514, i.e., a distance between the tip portion 512 of the nub 504 and a location of the surface 514 along the shell 506, is greater than a length L6 of the surface 516, i.e., a distance between the tip portion 512 of the nub 504 and a location of the surface 516 along the shell 506. For example, the length L5 can be 1.5 to 2.5 times longer than the length L6. Referring back to FIG. 5B, an angle between the surface 514 and a radial axis Y4 extending through the tip portion 512 of the nub 504 can be between 30 and 60 degrees, and an angle between the surface 514 and the radial axis Y4 can be no more than 15 degrees.

The nub 504 can be one nub of multiple nubs 518 of the sheath 502. For example, as shown in FIG. 5B, the sheath 502 can include two nubs 518. In other implementations, the sheath 502 can include fewer or more nubs, e.g., 1 nub, 3 nubs, 4 nubs, 5 nubs, 6 nubs, 7 nubs, 8 nubs, or more. The vane 503 can be positioned circumferentially between the two nubs 518. In implementations in which the sheath 502 includes multiple vanes 520 (similar to the vanes 142), each nub 518 can be circumferentially positioned between two corresponding vanes 520 adjacent to one another. Similar to the vanes 142, the nubs 518 can extend along helical paths along an outer surface of the shell 506, the helical paths having pitches similar to pitches of the helical paths of the vanes 520.

Figure 6A:
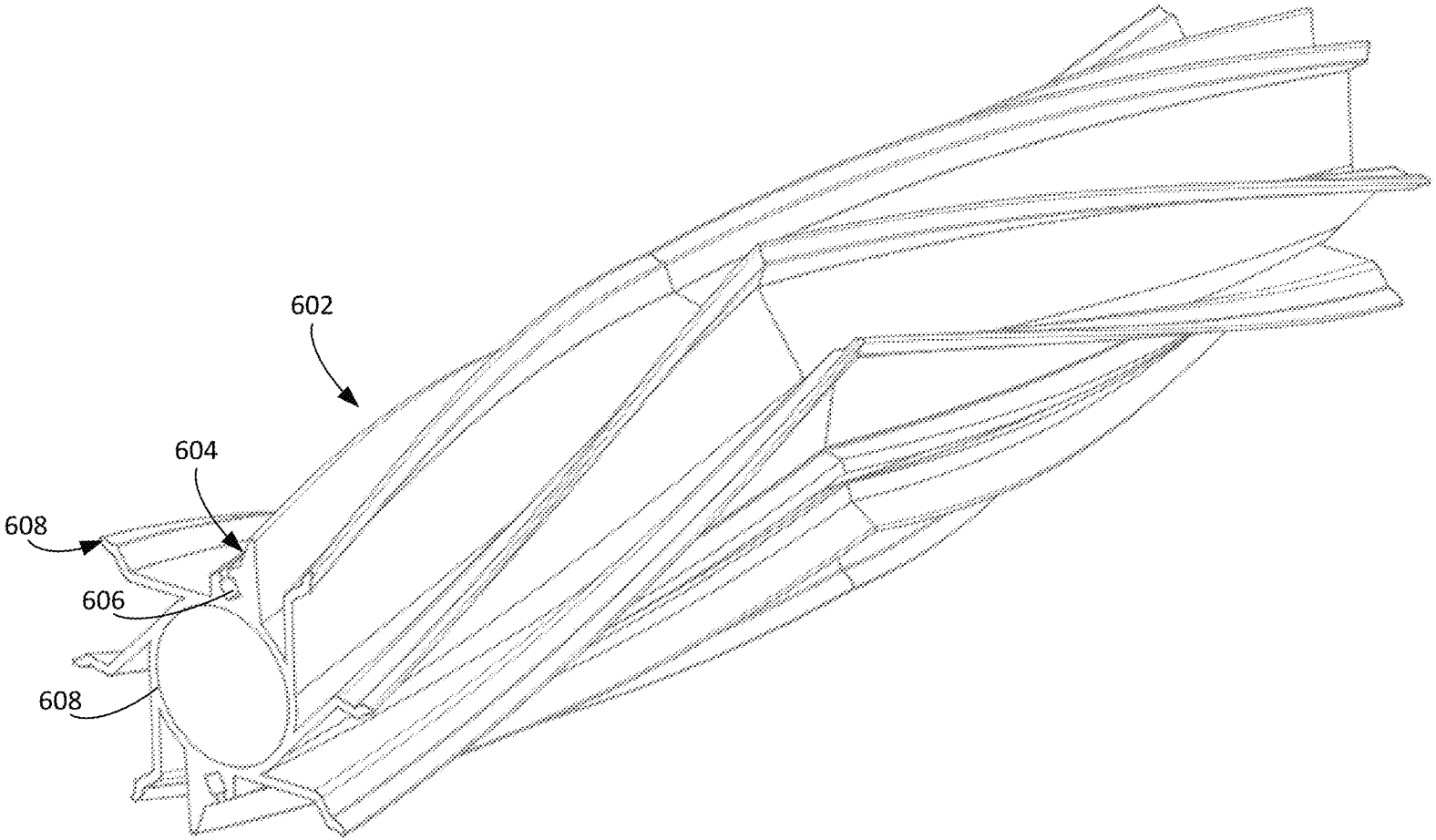
FIGS. 6A-6B are perspective and side views, respectively, of a further example of a sheath of a cleaning roller including a vane.

The configuration of nubs of a roller can vary in certain implementations. In some implementations, referring to FIG. 6A, a sheath 602 can be similar to the sheath 502 except that a nub 604 of the sheath 602 includes an opening 606. The opening 606 can be for receiving a bristle brush. The bristle brush can be an elongate member containing pliable bristles. The elongate member can extend through the opening 606 from a first longitudinal end of the nub 604 to a second longitudinal end of the nub. The bristles of the elongate member can be used for sweeping debris and agitating debris on the floor surface.

The nub 604 is positioned between two vanes, including a vane 610 and a vane 611. The opening 606 is positioned proximate an elongate member, e.g., the shell 608 (similar to the shell 112) of the sheath 602. Similar to the nub 504, the nub 604 can be more rigid than the vane 610 (similar to the vane 114) of the sheath 602, and can have geometric features that provide rigidity to the nub 604 similar to geometric features of the nub 504, e.g., a maximum thickness of the nub 604 can be similar to a maximum thickness of the nub 504, and a height of the nub 604 can be similar to the height H3 of the nub 504. In some implementations, the height of the nub 604 can be selected such that the nub 604 directly contacts obstacles under the robot and allows the roller to move over the obstacles. Unlike implementations in which the vane contacts the nub, and the vane and nub together support the roller against an obstacle, in some implementations, the nub directly contacts the obstacle and supports the roller against the obstacle. In such implementations, a height of the nub relative to a height of the vane is greater than a height of the nub relative to a height of the vane in implementations in which the vane and the nub both support the roller against the obstacle. For example, in implementations in which the nub directly supports the roller against the obstacle, the height of the nub can be at least 35% of the height of the vane, e.g., at least 40%, at least 45%, or at least 50% of the height of the vane. In implementations in which the nub supports the roller against the obstacle through the vane after the vane is deflected, the height of the nub can be at most 70%, of the height of the vane, e.g., at most 65%, at most 60%, at most 55%, or at most 50% of the height. In such implementations, the nub also prevents the vane from deflecting any further after the vane contacts the nub. Whether the nub supports the roller against an obstacle through the vane or directly can also depend on a tangential distance between the roller and the nub and a deflectability of the vane.

Figure 6B:
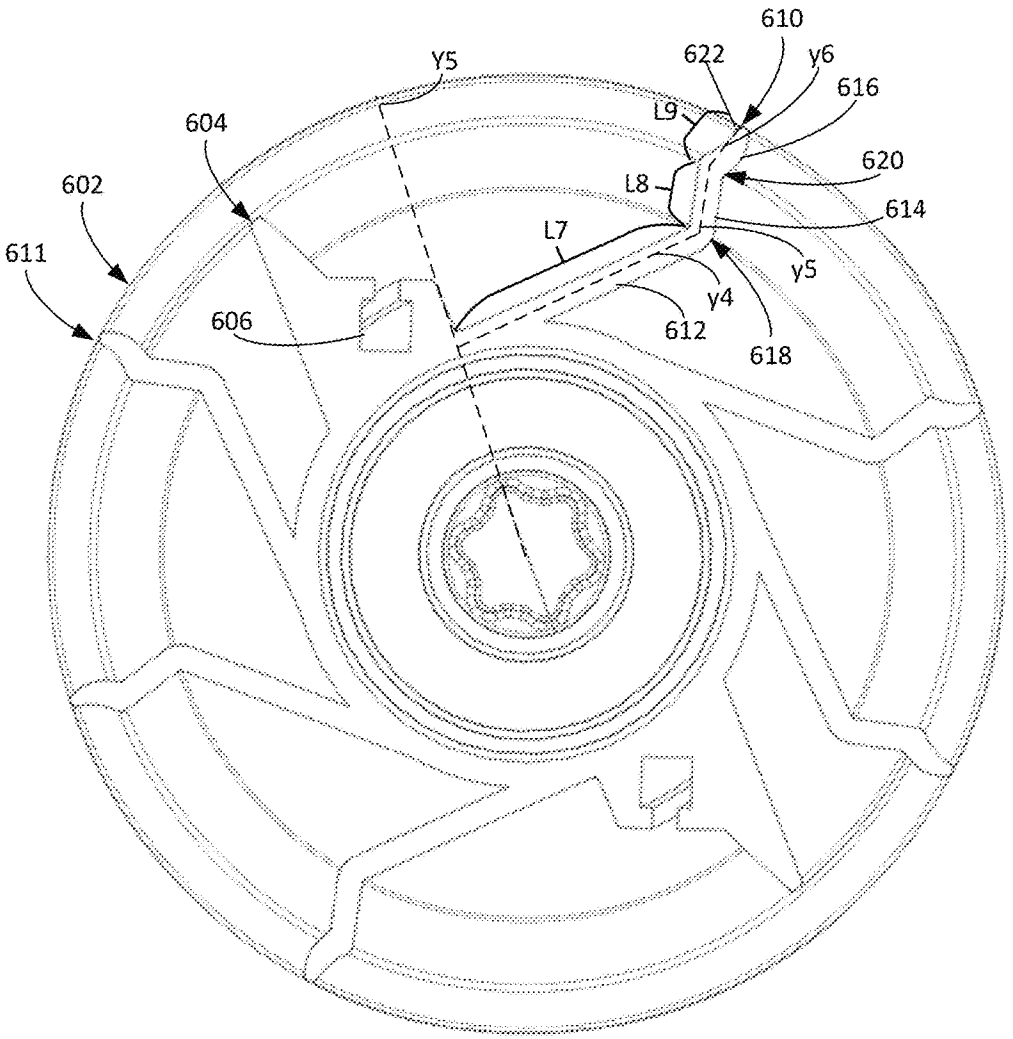

Referring to FIG. 6B, the opening 606 can include a rectangular or square cross-sectional portion. The opening 606 can have a maximum width between 2 and 8 millimeters.

Figure 6C:
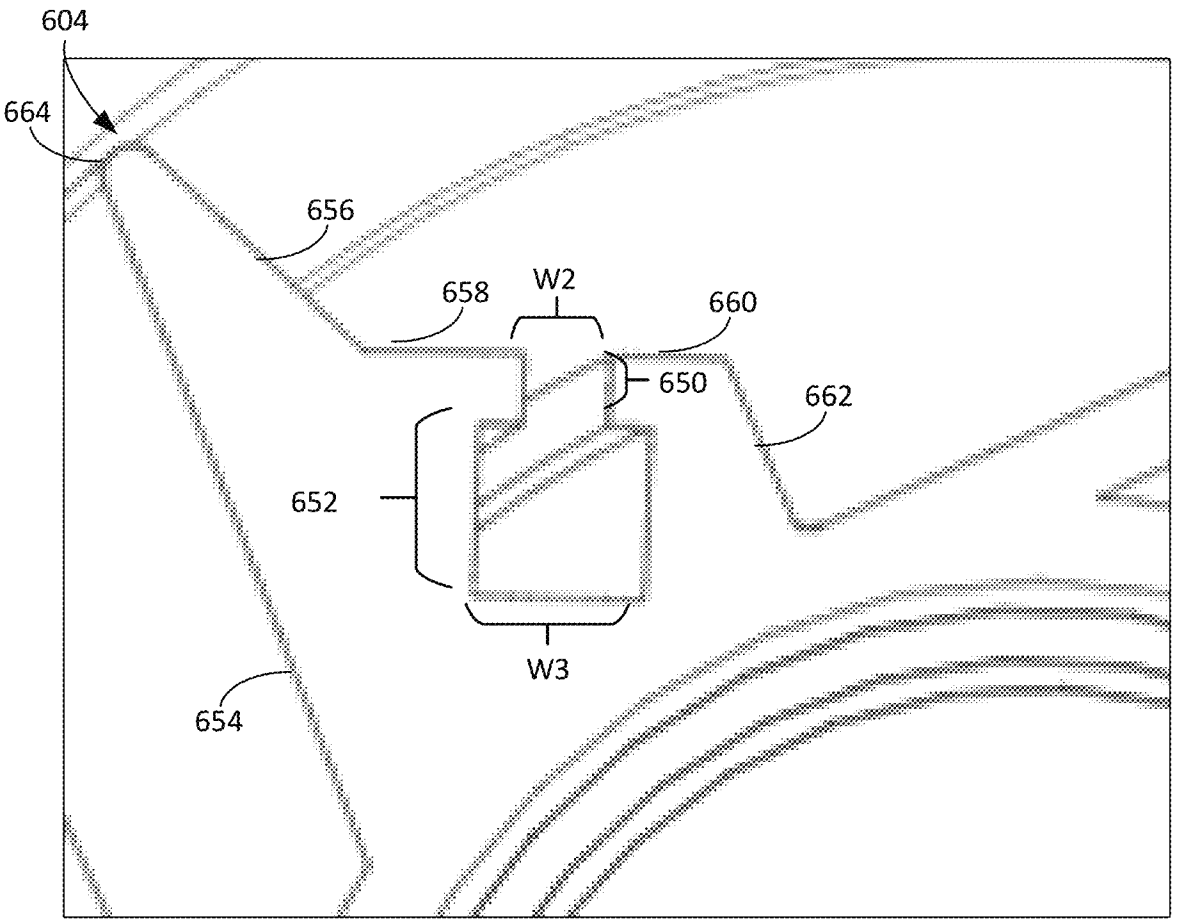
FIG. 6C is an enlarged side view of a nub of the sheath of FIG. 6A.

Referring to FIG. 6C, the nub 604 includes a surface 654 facing a first tangential direction, and a set of surfaces including surfaces 656, 658, 660, and 662 facing a second tangential direction. The surfaces 654, 656, 658, 660, 662 are each straight. The surface 662 extends outwardly from the shell 608, the surface 660 extends outwardly from the surface 662, the opening 606 extends between the surface 662 and the surface 658, the surface 658 extends outwardly from the opening 606, and the surface 656 extends outwardly from the surface 658. The surface 658 and the surface 654 meet at a tip portion 664 of the nub 604.

The opening 606 extends radially inwardly from the surfaces 658, 660. The opening 606 faces the second tangential direction. The opening 606 includes a first portion 650 adjacent to a second portion 652. The first portion 650 extends from the surfaces 658, 660 to the second portion 652 of the opening 606. The first portion 650 can be rectangular. The second portion 652 extends from the first portion 650 toward the shell 608. The second portion 652 is rectangular. The second portion 652 radially inward relative to the first portion 650 and thus is positioned closer to the longitudinal axis of the roller than the first portion 650 of the opening 606. The first portion 650 has a width W2, and the second portion 652 has a width W3. The width W2 is less than the width W3. The width W2 is between 1 and 4 millimeters, e.g., between 1 and 3 millimeters, 1.5 and 3.5 millimeters, or between 2 and 4 millimeters. The width W3 is 1.5 to 2.5 times longer than the width W2.

In some implementations, as shown in FIG. 6B, the sheath 602 can be similar to the sheath 502 except that the vane 610 can include a first portion 612, a second portion 614, and a third portion 616. The vane 610 can include a first bend 618 where the first portion 612 is attached to the second portion 614 and a second bend 620 where the second portion 614 is attached to the third portion 616. The first bend 618 is between the shell 608 and the second bend 620, and the second bend 620 is between the first bend 618 and a tip portion 622 of the vane 610. A first end 612*a* of the first portion 612 is attached to the shell 608 at a location intersecting a radial axis Y5 of the roller (not shown), and a second end 612*b* of the second portion 612 is attached to a first end 614a of the second portion 614 at the first bend 618. A second end 614*b* of the second portion 614 is attached to a first end 616*a* of the third portion 616 at the second bend 620. The third portion 616 terminates at the tip portion 622.

The first, second, and third portions 612, 614, 616 extend along axes y4, y5, y6, respectively. An angle between the axis y4 and the radial axis Y5 is similar to the angle between the axis y1 and the radial axis Y1 described herein. The angle between the axis y4 and the radial axis Y5 is greater than an angle between the axis y5 and the radial axis Y5. An angle between the axis y6 and the radial axis Y5 can be substantially similar to the angle between the axis y4 and the radial axis Y5, e.g., within 5% to 15% of the angle between the axis y4 and the radial axis Y5. For example, the angle between the axis y6 and the axis y4 is no more than 5 to 15 degrees.

The angle between the axis y5 and the radial axis Y5 is less than the angle between the axis y6 and the radial axis Y6. In some implementations, the axis y6 is parallel to the axis y4. In some implementations, the angle between the axis y6 and the radial axis Y5 can be less than the angle between the axis y4 and the radial axis Y5.

The angle between the axis y4 and the axis y5 can be between 90 and 170 degrees, e.g., between 90 and 150 degrees, 90 and 130 degrees, or 90 and 110 degrees, or about 95, 105, or 115 degrees. The angle between the axis y5 and the axis y6 can be between 90 and 170 degrees, e.g., between 90 and 150 degrees, 90 and 130 degrees, or 90 and 110 degrees, or about 95, 105, or 115 degrees. The angle between the axis y4 and the axis y6 can be less than 20 degrees, e.g., less than 15 degrees, less than 10 degrees, or less than 5 degrees.

The first and second portions 612, 614 of the vane 610 can have thicknesses similar to the thicknesses described with respect to the first and second portions 116, 118 of the vane 114 as described herein. A thickness of the third portion 616, in some implementations, can taper toward the tip portion 622.

A length L7 of the first portion 612 of the vane 610 is between 0.5 and 3 centimeters, e.g., between 0.5 and 2.5 centimeters, 0.5 and 2 centimeters, or 1 and 2 centimeters. A length L8 of the second portion 614 of the vane 610 is between 0.2 and 1 centimeters, e.g., between 0.2 and 0.8 centimeters or 0.4 and 1.0 centimeters. A length L9 of the third portion 616 of the vane 610 is between 0.2 and 0.8 centimeters, e.g., between 0.2 and 0.6 centimeters or 0.4 and 0.8 centimeters. The length L9 is between 10% and 30% of the length L7, e.g., between 10% and 20%, 15% or 25%, or 20% and 30% of the length L7. The length L9 is between 60% and 90% of the length L8, e.g., between 60% and 80%, 65% and 85%, or 70% and 90% of the length L8. The length L8 is between 15% and 35% of the length L7, e.g., between 15% and 25%, 20% and 30%, or 25% and 35% of the length L7.

While the opening 178 is described as tapering toward an outer tip of the vane 114, in some implementations, the opening 178, the openings 180, or a combination thereof can be slits that extend through a thickness of the vane 114. The slits can have a uniform width, and can extend through an entire length of the first portion 116 of the vane 114 or through only a portion of the first portion 116 of the vane 114.

The first portion 116 of the vane 114 shown in FIG. 4B and the first and second portions 612, 614 shown in FIG. 6B are depicted as being straight portions having uniform thicknesses, with surfaces facing a first tangential direction being substantially parallel to surfaces facing a second tangential direction. In some implementations, these portions can include curvature, protrusions, nonuniform thicknesses, or other geometric features.

While some of the foregoing examples are described with respect to a single roller 104, the robot 102 can includes multiple rollers in some implementations. For example, the robot 102 can include two rollers. In some implementations, a first roller is distinct from a second roller, e.g., can include certain features that differ from the features of the second roller.

Figure 8:
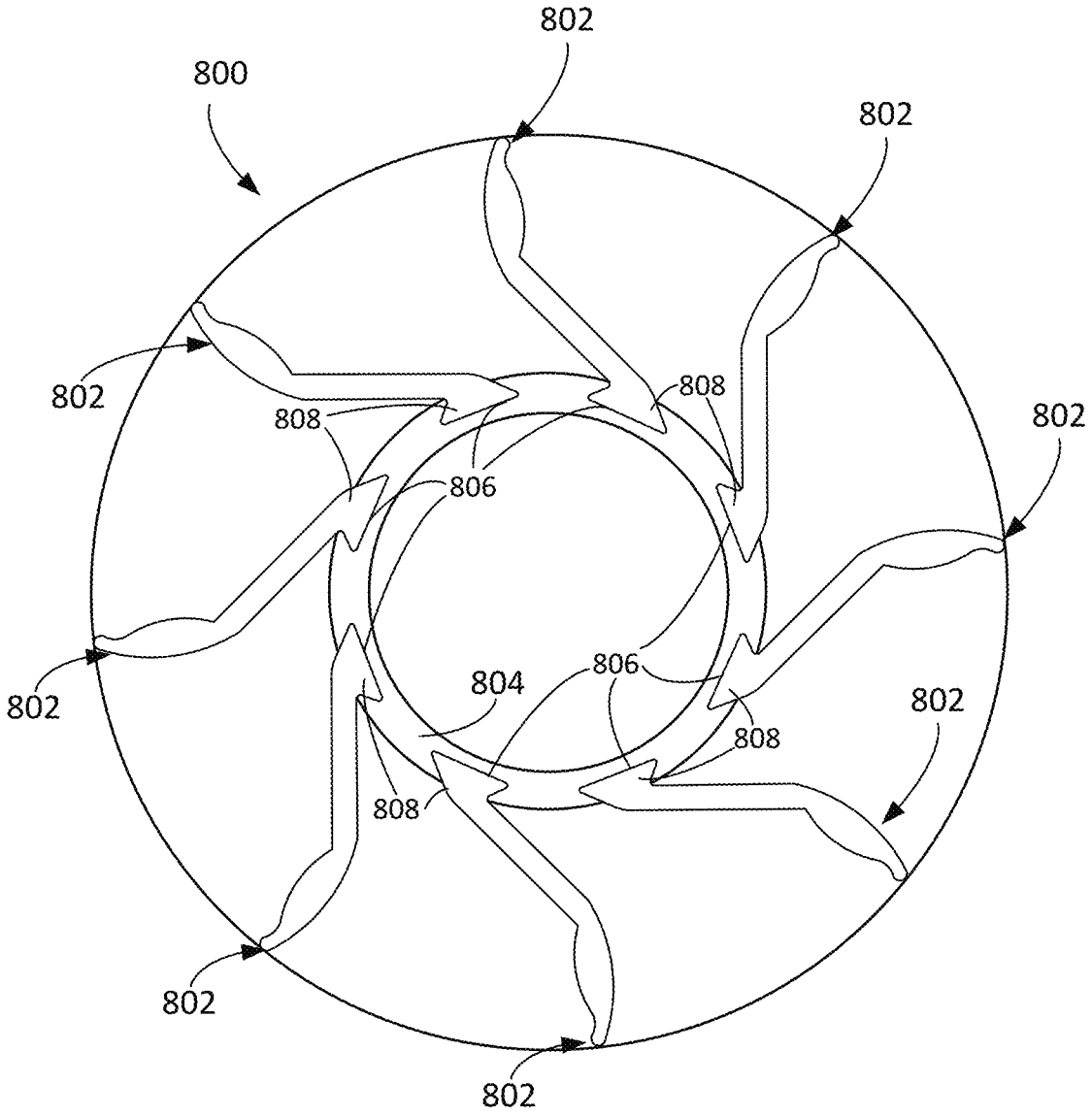
FIG. 8 is a cross-sectional side view of a further example of a cleaning roller.

While the roller 104 is described as having a sheath 110, and the elongate member 107 is described as corresponding to a shell 112 of the sheath 110, the elongate member 107 can vary in other implementations. In some implementations, the elongate member 107 is a cylindrical rod, a square rod, or other prismatic rod. In some implementations, the elongate member 107 is hollow, and in some implementations, the elongate member 107 is solid. Referring to FIG. 8, a roller 800 includes vanes 802 and an elongate member 804. The vanes 802 can be geometrically similar to any of the vanes described herein, e.g., the vanes 114. In contrast to the vanes 114, the vanes 802 are distinct from the elongate member 804, and are longitudinally slidable relative to the elongate member 804. In particular, to assemble the roller 800, the vanes 802 are installed on slots 806 extending longitudinally along the elongate member 804. The vanes 802 include proximal portions 808 that fit within the slots 806. The proximal portions 808 are configured to inhibit radial outward movement of the vanes 802 relative to the elongate member 804. For example, the proximal portions 808 include taper in the radially outward direction, and the slots 806 also taper in the radially outward direction. In some implementations, the elongate member 804 is part of a sheath of the roller 800. In other implementations, the elongate member 804 is part of a core of the roller 800.

While described by way of example with respect to the roller 800, the features of the vanes 802 can be applicable to other implementations. For example, in some implementations, the vanes 114 of the roller 104 could include features similar to the features of the vanes 802. In some implementations, if the roller includes nubs, the nubs can be slidable into slots along the elongate member.

Figure 9:
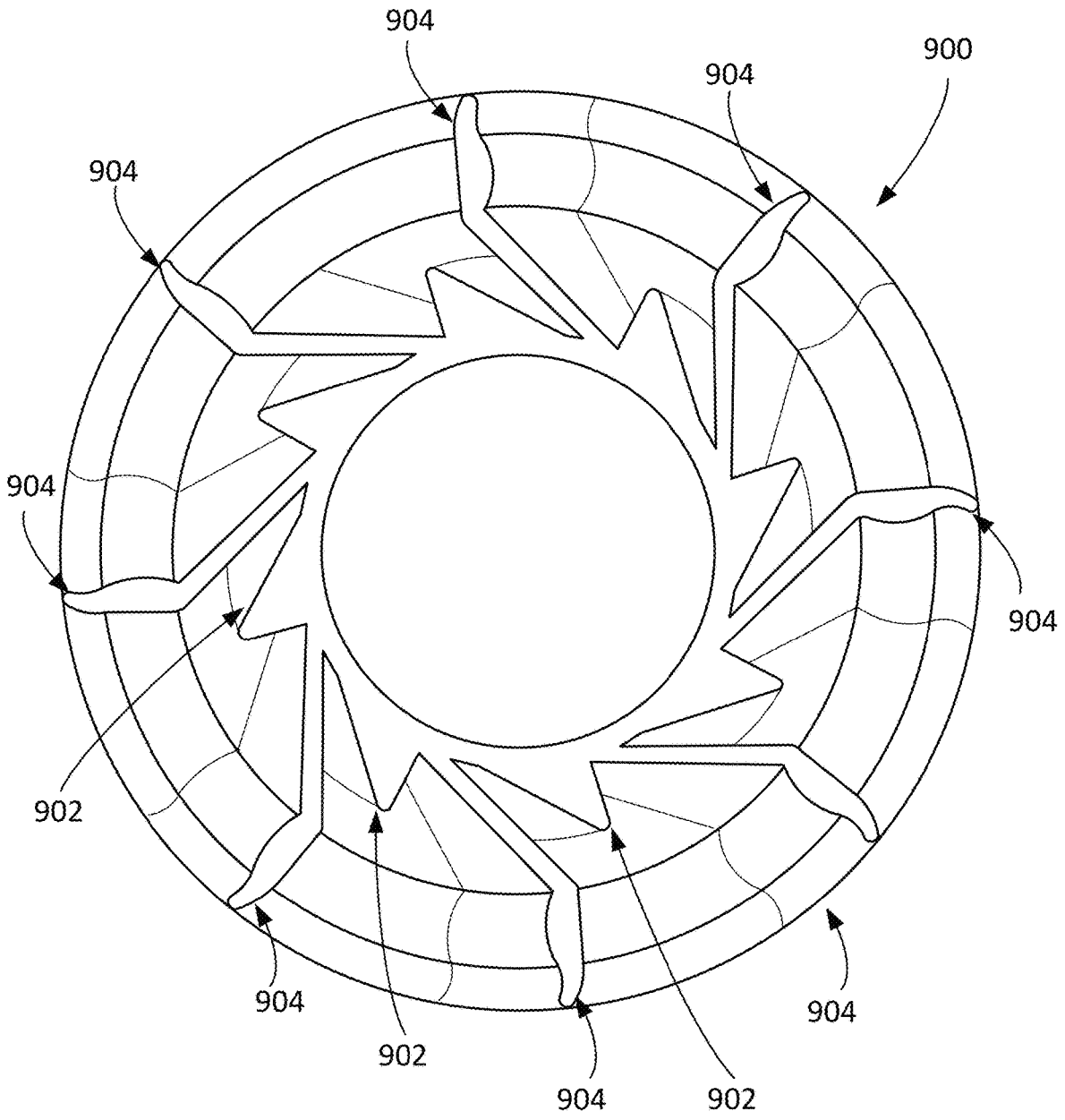
FIGS. 9-11 are cross-sectional side views of further examples of sheaths of a cleaning rollers.

As described herein, in implementations in which a cleaning roller includes nubs, the quantity of and the configuration of the nubs may vary. In the example shown in FIG. 5A, the roller includes two nubs 518. Referring to FIG. 9, a sheath 900 for a cleaning roller can include nubs 902 and vanes 904. The nubs 902 can have geometric configurations similar to the geometric configurations of the nubs 518.

The nubs 902 and the vanes 904 are configured, as described herein, such that the nubs 902 contact the vanes 904 when the roller contacts an obstacle on the floor surface under the robot. In this regard, as the roller moves over an obstacle, the vanes 904 deflect into contact with the nubs 902, and the vanes 904 and the nubs 902 support the roller against the obstacle to allow the roller to clear the obstacle. Unlike the sheath 502, the sheath 900 includes a corresponding nub 902 for each vane 904. In particular, each nub 902 adjacent to a corresponding vane 904 in the counterclockwise direction as shown in FIG. 9 prevents the corresponding vane 904 from deflecting further after the vane 904 contacts the nub 902. In some implementations, the nub 902 prevents the first portion of the vane 904 (similar to the first portion 116 described herein) from deflecting further after the vane 904 contacts the nub 902. The nubs 902, for example, have a height that is at most 50% of a height of the vanes 904, e.g., at most 40%, at most 35%, or at most 30% a height of the vanes 904.

As described herein, in some implementations, the nubs may be configured such that the vanes do not contact the nubs when the vanes contact an obstacle on the floor surface. In the example shown in FIG. 10, a sheath 1000 includes vanes 1002*a*, 1002*b* and nubs 1004*a*, 1004*b*. Unlike the nubs 518, the nubs 1004*a*, 1004*b* are not triangularly shaped but rather extend radially outwardly along a trajectory similar to the trajectory of the vanes 1002*a*, 1002*b*. In particular, the nubs 1004*a*, 1004*b* can include multiple interconnected portions at bends along the nubs 1004*a*, 1004*b*.

Figure 10:
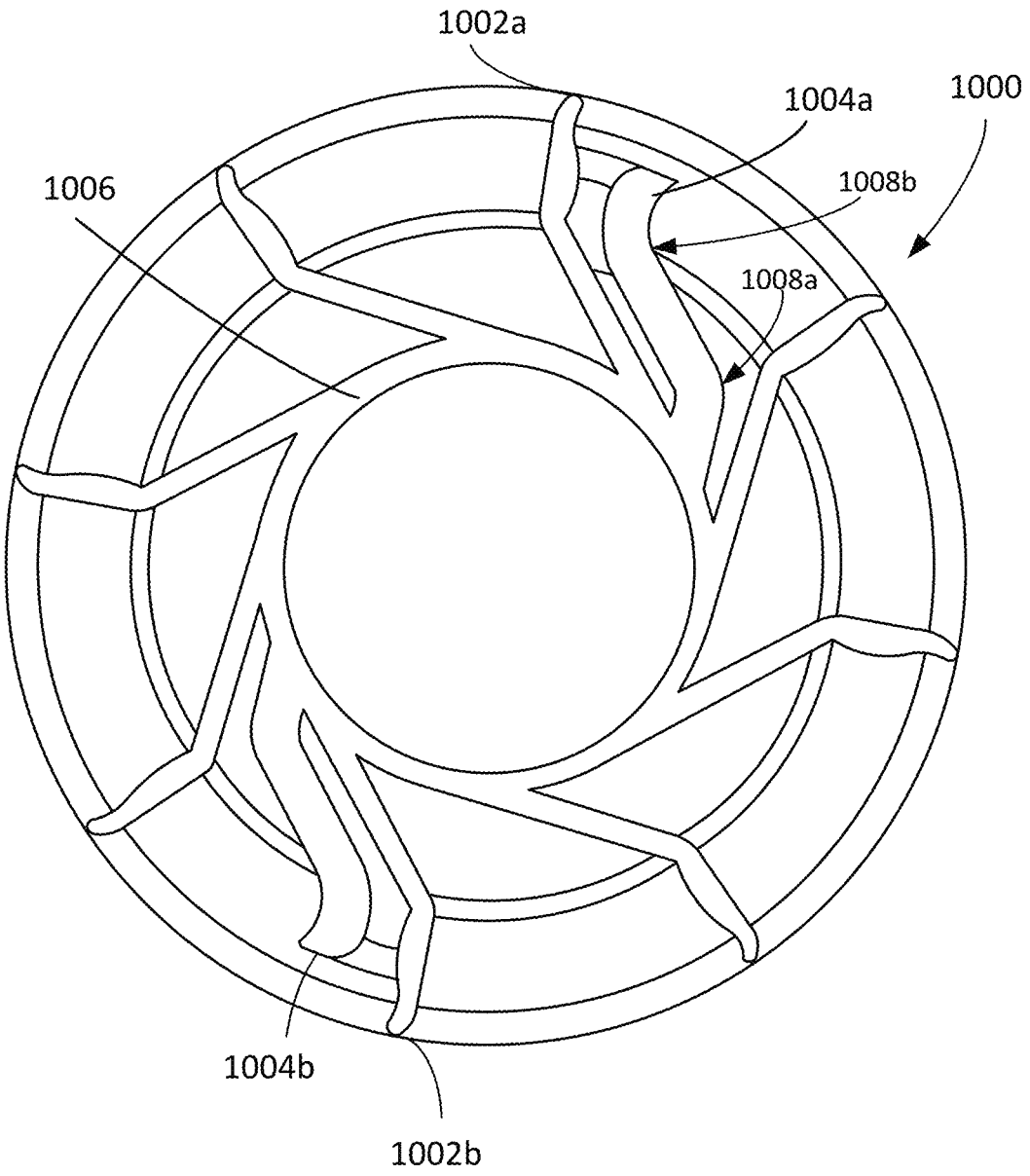

The nubs 1004*a*, 1004*b* are configured to contact an obstacle on the floor surface under the robot before the vanes 1002*a*, 1002*b* deflect into contact with the nubs 1004*a*, 1004*b*. In particular, the vanes 1002*a*, 1002*b* that are adjacent to the nubs 1004*a*, 1004*b* in the clockwise direction as shown in FIG. 10 deflect in the counterclockwise direction. Heights of the vanes 1002*a*, 1002*b* relative to a shell 1006 of the sheath 1000 decrease to a position below heights of the nubs 1004*a*, 1004*b* as the vanes 1002*a*, 1002*b* deflect, and decrease to this position before contacting the nubs 1004*a*, 1004*b*. The nubs 1004*a*, 1004*b* can include bends 1008*a*, 1008*b* that allow the nubs 1004*a*, 1004*b* to extend in a tangential direction away from the vanes 1002*a*, 1002*b*. Unlike the nubs 518 that have thicknesses that taper outwardly from the shell 1006, the nubs 1004*a*, 1004*b* can uniform thicknesses from proximate the shell 1006 to proximate distal tips of the nubs 1004*a*, 1004*b*. The uniform thicknesses can be thicker than thicknesses of the vanes 1002*a*, 1002*b* such that the nubs 1004*a*, 1004*b* can more easily support the roller against an obstacle on the floor surface. For example, the nubs 1004*a*, 1004*b* can be 50% to 200% thicker than the vanes 1002*a*, 1002*b*, e.g., between 50% and 150%, 75% and 175%, or 100% and 200% thicker than the vanes 1002*a*, 1002*b*.

Figure 11:
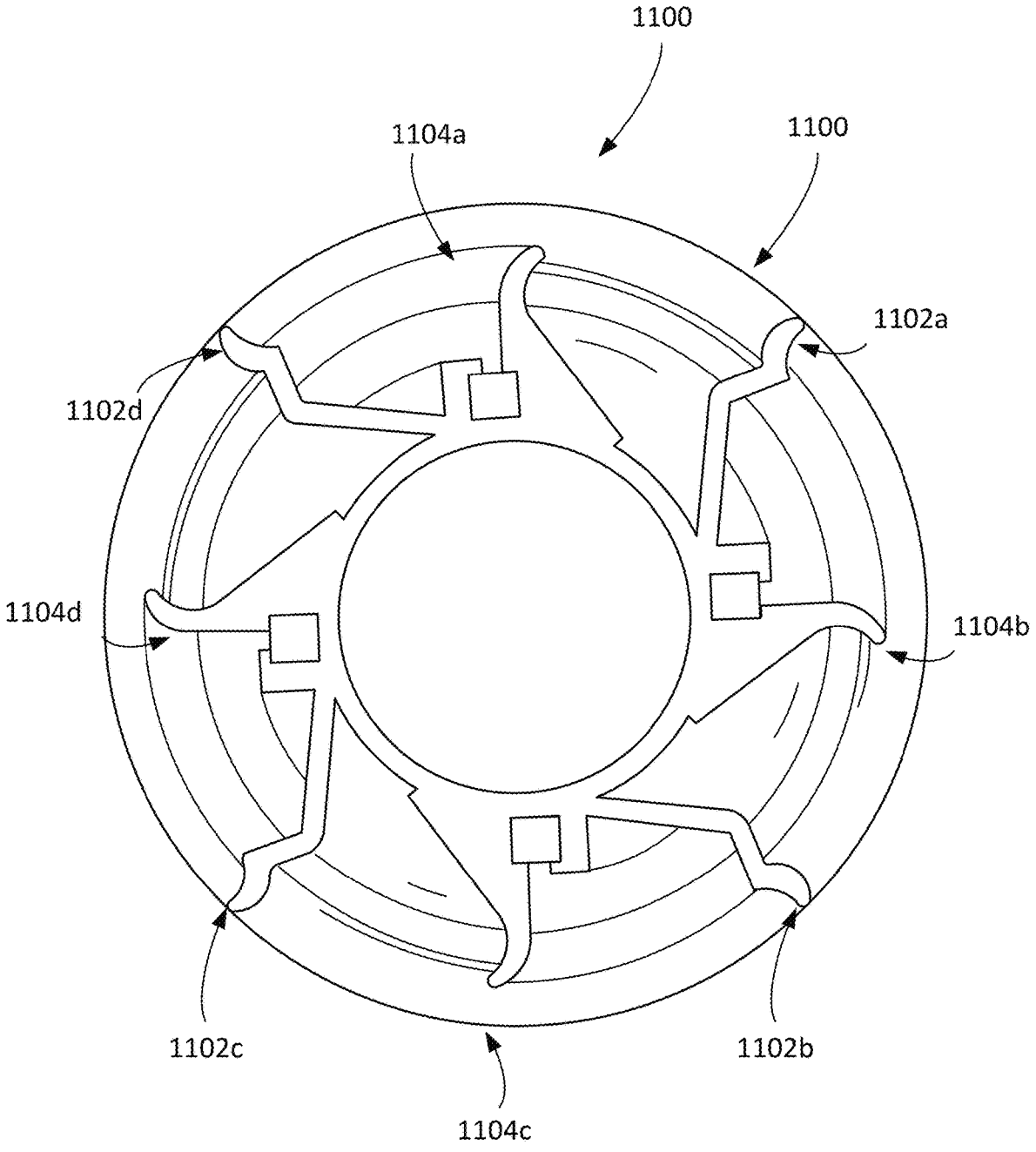

In the example shown in FIG. 11, a sheath 1100 includes vanes 1102*a*, 1102*b*, 1102*c*, 11026*d* and nubs 1104*a*, 1104*b*, 1104*c*, 1104*d*. The example shown in FIG. 11 is similar to the example shown in FIG. 10 in that the nubs 1104*a*, 1104*b*, 1104*c*, 1104*d* are configured to contact an obstacle on the floor surface under the robot before the vanes 1102*a*, 1102*b*, 1102*c*, 1102*d* deflect into contact with the nubs 1104*a*, 1104*b*, 1104*c*, 1104*d*, respectively. The nubs 1104*a*, 1104*b*, 1104*c*, 1104*d* have maximum thicknesses greater than the thicknesses of the nubs 1004*a*, 1004*b* described with respect to FIG. 10. In some implementations, the maximum thicknesses of the nubs 1104*a*, 1104*b*, 1104*c*, 1104*d* are similar to the maximum thicknesses of the nubs 518 or the nubs 604 described herein elsewhere. The nubs 1104*a*, 1104*b*, 1104*c*, 1104*d* have sufficient heights relative to and distances from the vanes 1102*a*, 1102*b*, 1102*c*, 1102*d* adjacent to the nubs 1104*a*, 1104*b*, 1104*c*, 1104*d* in the clockwise direction as shown in FIG. 11 such that, as the vanes 1102*a*, 1102*b*, 1102*c*, 1102*d* deflect in response to contact with an obstacle on the floor surface, the vanes 1102*a*, 1102*b*, 1102*c*, 1102*d* do not contact the nubs 1104*a*, 1104*b*, 1104*c*, 1104*d* before the nubs 1104*a*, 1104*b*, 1104*c*, 1104*d* contact the obstacle. The nubs 1104*a*, 1104*b*, 1104*c*, 1104*d*, upon contacting the obstacle, can assist the roller with moving over the obstacle.

Features described with respect to some implementations can be combined with or modified in view of features of other implementations. Accordingly, other implementations are within the scope of the claims.

What is claimed is:

1. A cleaning roller mountable to a cleaning robot, wherein the cleaning roller comprises:

an elongate member extending along a longitudinal axis of the cleaning roller, the cleaning roller rotatable about the longitudinal axis when the cleaning roller is mounted to the cleaning robot;

a vane attached to the elongate member, the vane configured to direct debris into an interior of the cleaning robot as the cleaning roller is rotated about the longitudinal axis; and a nub attached to the elongate member, the nub extending outwardly from the elongate member to support the cleaning roller on an obstacle located on a floor surface to lift the cleaning robot relative to the obstacle, a height of the nub above the elongate member being less than a height of the vane above the elongate member.

2. The cleaning roller of claim 1, wherein the nub is configured to support the cleaning roller against the obstacle as the cleaning roller travels over the obstacle.

3. The cleaning roller of claim 2, wherein the vane is configured to deflect and contact the nub in response to contact between the vane and the obstacle.

4. The cleaning roller of claim 1, wherein the vane is deflectable, and the nub is a rigid protrusion.

5. The cleaning roller of claim 1, wherein the nub comprises an angled surface that tapers from a portion of the nub attached to the elongate member to a tip portion of the nub.

6. The cleaning roller of claim 5, wherein the nub has a maximum thickness between 8 and 14 millimeters.

7. The cleaning roller of claim 6, wherein the maximum thickness of the nub corresponds to a thickness of a portion of the nub attached to the elongate member.

8. The cleaning roller of claim 7, wherein the height of the nub above the elongate member is between 0.25 and 2.0 centimeters, and the height of the vane is greater than the height of the nub.

9. The cleaning roller of claim 1, wherein the nub is a substantially rigid triangular protrusion extending from the elongate member.

10. The cleaning roller of claim 1, wherein the height of the nub above the elongate member is between 0.25 and 2.0 centimeters.

11. The cleaning roller of claim 10, wherein the height of the vane is 25% to 100% greater than the height of the nub.

12. A cleaning roller mountable to a cleaning robot, wherein the cleaning roller comprises:

an elongate member extending along a longitudinal axis of the cleaning roller, the cleaning roller rotatable about the longitudinal axis when the cleaning roller is mounted to the cleaning robot;

a vane attached to the elongate member, the vane configured to direct debris into an interior of the cleaning robot as the cleaning roller is rotated about the longitudinal axis; and a nub attached to the elongate member, the nub extending outwardly from the elongate member, a height of the nub above the elongate member being less than a height of the vane above the elongate member, wherein the nub comprises a first surface facing a first tangential direction of the cleaning roller and a second surface facing a second tangential direction of the cleaning roller, wherein a length of the first surface is greater than a length of the second surface.

13. The cleaning roller of claim 12, wherein the length of the first surface is 1.5 to 2.5 times longer than the length of the second surface.

14. The cleaning roller of claim 12, wherein the first surface and the second surface meet at a tip portion of the nub.

15. The cleaning roller of claim 1, wherein the vane is a first vane attached to the elongate member, the cleaning roller further comprises a second vane, and the nub is positioned between the first vane and the second vane.

16. The cleaning roller of claim 1, wherein the nub extends longitudinally and circumferentially along the elongate member along a helical path along the elongate member, and the nub is circumferentially offset along an outer surface of the elongate member relative to the vane.

17. The cleaning roller of claim 1, wherein the nub defines an opening extending through the nub along an axis parallel to the longitudinal axis.

18. The cleaning roller of claim 1, wherein the nub is a first nub, and the cleaning roller comprises a second nub extending outwardly from the elongate member, a height of the second nub above the elongate member being less than the height of the vane above the elongate member.

19. The cleaning roller of claim 18, wherein the vane is circumferentially positioned along the elongate member between the first nub and the second nub.

20. The cleaning roller of claim 18, further comprising a plurality of vanes and a plurality of nubs arranged circumferentially around the elongate member, wherein each nub of the plurality of nubs is positioned between a respective pair of vanes of the plurality of vanes.

21. The cleaning roller of claim 1, wherein the vane and the nub are shaped and sized to prevent the vane from deflecting past the nub.

22. The cleaning roller of claim 21, wherein the nub has a substantially uniform thickness from the elongate member to a distal tip of the nub, the substantially uniform thickness of the nub being greater than a thickness of the vane.

23. The cleaning roller of claim 22, wherein a portion of the vane is parallel to a portion of the nub.

24. The cleaning roller of claim 1, wherein the nub supports the cleaning roller on the obstacle during a rotation of the cleaning roller to lift the cleaning robot relative to the obstacle.

25. A cleaning robot comprising:

a drive system to move the cleaning robot across a floor surface; and a cleaning roller mounted to the cleaning robot along a bottom portion of the cleaning robot, the cleaning roller rotatable about a longitudinal axis of the cleaning roller to clean the floor surface as the cleaning robot is moved across the floor surface, wherein the cleaning roller comprises:

a vane attached to an outer surface of the cleaning roller, the vane configured to direct debris into an interior of the cleaning robot as the cleaning roller is rotated about the longitudinal axis; and a nub attached to the outer surface of the cleaning roller, the nub extending outwardly from the outer surface to support the cleaning roller on an obstacle located on the floor surface to lift the cleaning robot relative to the obstacle, a height of the nub above the outer surface being less than a height of the vane above the outer surface.

26. The cleaning robot of claim 25, wherein the nub comprises:

a distal tip portion;

a first surface facing a first tangential direction of the cleaning roller; and a second surface facing a second tangential direction of the cleaning roller, the first surface and the second surface meeting at the distal tip portion, wherein a length of the first surface is greater than a length of the second surface.

27. The cleaning robot of claim 25, wherein:

the nub extends longitudinally and circumferentially along the cleaning roller along a helical path along the cleaning roller, the vane is a first vane attached to the outer surface, and the cleaning roller further comprises a second vane, and the nub is positioned between the first vane and the second vane.

28. The cleaning robot of claim 25, wherein:

the cleaning roller is a first cleaning roller; and the cleaning robot further comprises:

a second cleaning roller rotatable about a longitudinal axis of the second cleaning roller to clean the floor surface as the cleaning robot is moved across the floor surface.

29. The cleaning robot of claim 25, wherein the drive system is configured to rotate the cleaning roller to lift the cleaning robot relative to the obstacle while the nub is supported on the obstacle.

30. The cleaning robot of claim 25, wherein the drive system is configured to rotate the cleaning roller to lift the cleaning robot over the obstacle.

31. The cleaning robot of claim 25, wherein the nub comprises a substantially rigid protrusion to support the cleaning roller on the obstacle.

32. The cleaning robot of claim 25, wherein the vane is configured to contact the obstacle and deflect to contact the nub to support the cleaning roller on the obstacle.

33. The cleaning robot of claim 25, wherein a portion of the nub is configured to contact the obstacle when the cleaning roller is supported on the obstacle by the nub.

34. The cleaning robot of claim 33, wherein the portion of the nub configured to contact the obstacle is a curved portion arranged at a distal tip of the nub.

* * * * *